US011526110B2

(12) United States Patent
Matsumoto et al.

(10) Patent No.: US 11,526,110 B2
(45) Date of Patent: Dec. 13, 2022

(54) IMAGE FORMING APPARATUS

(71) Applicant: CANON KABUSHIKI KAISHA, Tokyo (JP)

(72) Inventors: Shogo Matsumoto, Shizuoka (JP); Kimitaka Ichinose, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/545,690

(22) Filed: Dec. 8, 2021

(65) Prior Publication Data

US 2022/0197206 A1 Jun. 23, 2022

(30) Foreign Application Priority Data

Dec. 22, 2020 (JP) ..... JP2020-212491

(51) Int. Cl.
*G03G 15/00* (2006.01)
*G03G 15/16* (2006.01)
*G03G 15/01* (2006.01)

(52) U.S. Cl.
CPC ..... *G03G 15/556* (2013.01); *G03G 15/0131* (2013.01); *G03G 15/161* (2013.01)

(58) Field of Classification Search
CPC . G03G 15/161; G03G 15/0131; G03G 15/556
See application file for complete search history.

(56) References Cited

U.S. PATENT DOCUMENTS

2017/0023888 A1* 1/2017 Shibasaki ..... G03G 15/5058

FOREIGN PATENT DOCUMENTS

| | | | |
|---|---|---|---|
| JP | 2006154519 | A | 6/2006 |
| JP | 2010250355 | A | 11/2010 |
| JP | 2012230250 | A | 11/2012 |

* cited by examiner

*Primary Examiner* — Clayton E. LaBalle
*Assistant Examiner* — Michael A Harrison
(74) *Attorney, Agent, or Firm* — Canon U.S.A., Inc. I.P. Division

(57) ABSTRACT

An image forming apparatus that has an image bearing member to be removably mounted to the image forming apparatus includes an intermediate transfer member, a toner detection unit, an exposure device, a forming unit, and a judgment unit. The judgment unit judges a mounting state of the image bearing member based on whether the toner detection unit detects a toner image transferred on a surface of the intermediate transfer member. When the image bearing member is mounted, first and second patterns of toner images are formed apart by a predetermined interval in a rotation direction of the intermediate transfer member. Where the toner detection unit detects the first and second patterns of toner images, the judgment unit judges that the image bearing member is mounted. Where one of the first and second patterns is not detected, the judgment unit judges that the image bearing member is not mounted.

17 Claims, 20 Drawing Sheets

IMAGE FORMING APPARATUS

BACKGROUND OF THE DISCLOSURE

Field of the Disclosure

The present disclosure relates to an image forming apparatus, and more particularly to an image forming apparatus such as a printing apparatus, for example, a copying machine, a laser beam printer, or a facsimile.

Description of the Related Art

Hitherto, as an image forming apparatus using electrophotography, there has been known an image forming apparatus using an intermediate transfer member. A toner image is transferred from the intermediate transfer member to a transfer material, but not the entirety of the toner image is transferred to the transfer material. Thus, it is required that toner that remains on the intermediate transfer member (hereinafter referred to as "residual toner") be removed, that is, the intermediate transfer member be cleaned. As a cleaning system, a blade cleaning system is widely employed. In order to improve wear resistance of a cleaning blade, there has been proposed a configuration of applying protrusions and recesses on a surface of the intermediate transfer member (Japanese Patent Application Laid-Open No. 2010-250355).

Meanwhile, in an image forming apparatus using electrophotography, a system in which a process cartridge is mountable to and removable from an image forming apparatus main body is employed. In the image forming apparatus that employs such a mountable and removable system, it is required that a mounting state of the process cartridge be notified to a user. For example, there has been proposed a toner image detection system for judging a mounting state of the process cartridge by detecting, with use of a sensor configured to detect toner, presence or absence of a toner image transferred from the process cartridge to the intermediate transfer member (Japanese Patent Application Laid-Open No. 2006-154519).

In the mounting detection for the process cartridge by the toner image detection system, when a region in which a characteristic locally varies is present on the surface of the intermediate transfer member, output of the sensor may locally vary. For example, in a case in which a sensor configured to optically detect a toner image is used, when a region in which an optical characteristic locally varies is present on the surface of the intermediate transfer member, output of the sensor may locally vary. As a result, there is a risk in that the region is erroneously detected as a region in which the toner image is formed.

The following countermeasure is taken against such erroneous detection. A size of the region in which the characteristic varies is assumed, and a toner image which is larger than the assumed size is formed. When the toner image formed with the intended size can be detected, it can be judged that the process cartridge is mounted. However, in this case, it is required that a larger toner image be formed.

Further, the following can be contemplated as another countermeasure. A toner image is formed in such a manner as to avoid the region in which the characteristic varies. Accordingly, the mounting detection for the process cartridge is performed without being affected by the region. However, in this case, in order to form the toner image while avoiding the region, it is required that a position of the region be specified. For example, in a mode in which the position of the region can be specified with use of a sensor configured to detect toner, it is required that the intermediate transfer member be rotated by at least one turn. As a result, a time for executing the mounting detection for the process cartridge becomes longer. Further, there is a risk of affecting the lifetime of the process cartridge and the intermediate transfer member.

SUMMARY OF THE DISCLOSURE

Disclosed herein is an image forming apparatus that works towards improving accuracy of the mounting detection for the process cartridge while suppressing consumption of toner.

According to an aspect of the present disclosure, an image forming apparatus that has an image bearing member to be removably mounted to the image forming apparatus includes an intermediate transfer member which is rotatable, and to which a toner image borne by the image bearing member is to be transferred, a toner detection unit configured to detect the toner image on a surface of the intermediate transfer member, an exposure device configured to expose the image bearing member, a forming unit configured to control the exposure device so that the exposure device performs a first exposure operation, and a second exposure operation after elapse of a predetermined time period from the first exposure operation, and a judgment unit configured to judge a mounting state of the image bearing member based on whether or not the toner image transferred on the surface of the intermediate transfer member is detected by the toner detection unit, wherein, in a case in which the image bearing member is mounted, a first pattern including a first toner image is formed by the first exposure operation, and a second pattern including a second toner image is formed by the second exposure operation, where the second pattern is formed apart from the first pattern by a predetermined interval in a rotation direction of the intermediate transfer member, wherein, in a case in which the first pattern and the second pattern are detected by the toner detection unit, the judgment unit judges that the image bearing member is mounted, and wherein, in a case in which at least one of the first pattern and the second pattern is not detected by the toner detection unit, the judgment unit judges that the image bearing member is not mounted.

Further features of the present disclosure will become apparent from the following description of exemplary embodiments with reference to the attached drawings.

DESCRIPTION OF THE EMBODIMENTS

Now, embodiments of the present disclosure are described. Unless otherwise particularly described, materials, shapes, relative positions, and the like of components described in the embodiments are not intended to limit the present disclosure.

First Embodiment (Outline of Image Forming Apparatus)

Figure 1:
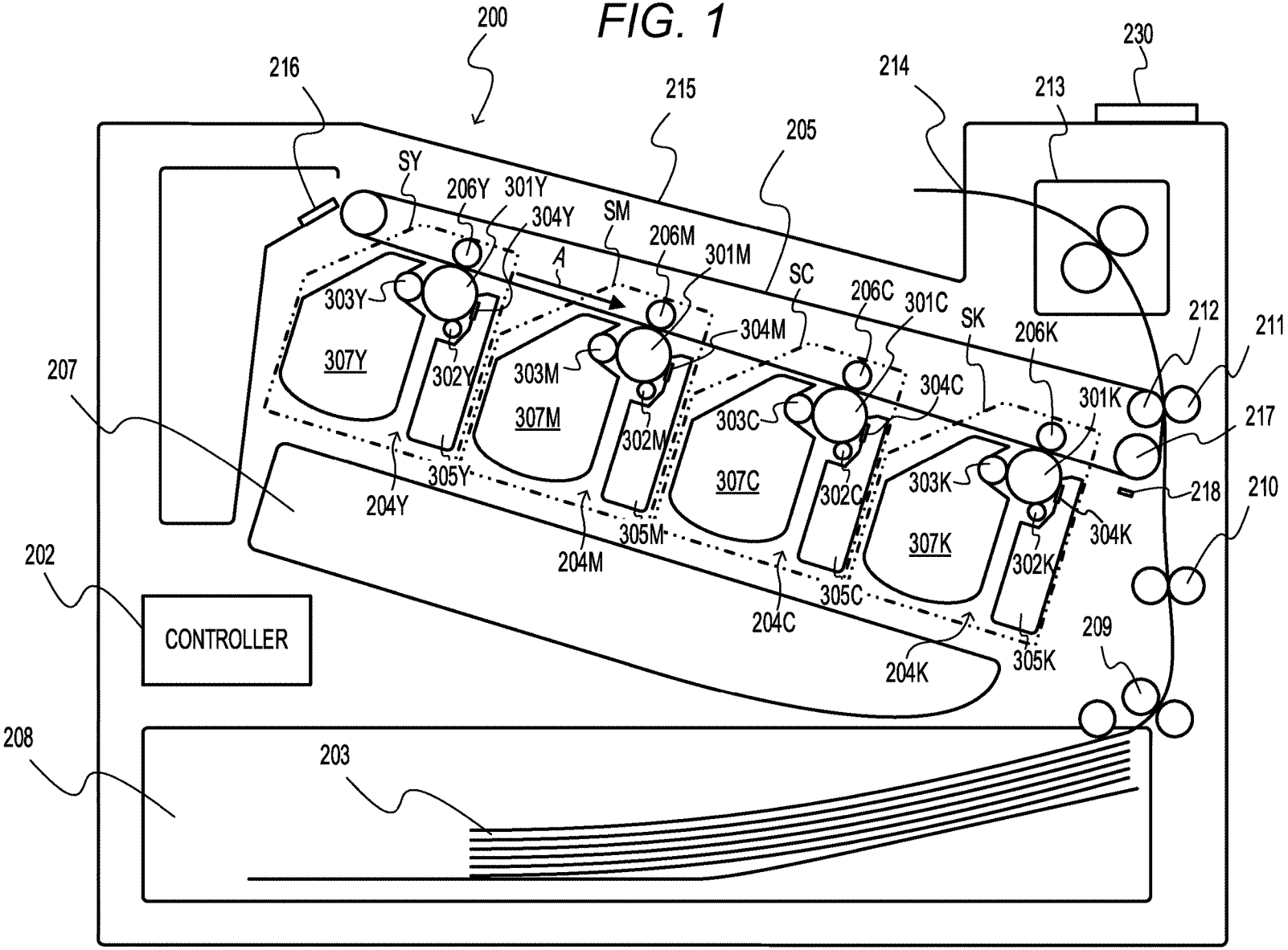
FIG. 1 is a schematic configuration view of an image forming apparatus according to a first embodiment, a second embodiment, and a third embodiment.

FIG. 1 is a schematic configuration view of an image forming apparatus 200 according to a first embodiment of the present disclosure. The image forming apparatus 200 is a full-color laser printer that employs an in-line system and an intermediate transfer system. The image forming apparatus 200 forms a full-color image on a recording material 203 in accordance with image information input from a controller 202.

The image forming apparatus 200 includes image forming stations SY, SM, SC, and SK for respective colors of yellow, magenta, cyan, and black. The image forming station SY includes a process cartridge 204Y, a rotatable intermediate transfer belt 205 being an intermediate transfer member, and a primary transfer roller 206Y. The intermediate transfer belt 205 is an endless belt, and rotates in a direction indicated by an arrow A of FIG. 1 (counterclockwise direction). The primary transfer roller 206Y is arranged on a side opposite to the process cartridge 204Y across the intermediate transfer belt 205.

The respective image forming stations SY, SM, SC, and SK are arranged in alignment with each other in the rotation direction A of the intermediate transfer belt 205, and are substantially the same as one another except for the color of an image to be formed. Therefore, unless otherwise distinguished from one another, the respective image forming stations of yellow, magenta, cyan, and black are collectively described by omitting the suffixes Y, M, C, and K each indicating that the component is provided for the corresponding color.

The process cartridge 204, which is mountable to and removable from the image forming apparatus 200, includes a photosensitive drum 301 serving as an image bearing member. In other words, the photosensitive drum 301 or the process cartridge 204 is removably mounted to the image forming apparatus 200. The image forming apparatus 200 includes a scanner unit 207 serving as an exposure device configured to expose the photosensitive drum 301. As the exposure device, an exposure device using a light emitting diode (LED) may also be used.

The photosensitive drum 301 is rotationally driven by a drive unit (not shown). A charging roller 302 has a high voltage applied by a high-voltage power supply (not shown), to thereby uniformly charge the surface of the photosensitive drum 301. Then, the scanner unit (exposure device or exposure unit) 207 irradiates the photosensitive drum 301 with laser light based on image information input to the controller 202, to thereby form an electrostatic latent image on the surface of the photosensitive drum 301.

A toner container 307 accommodates toner. The toner accommodated in the toner container 307 is supplied to a developing roller 303 by a stirrer (not shown). The developing roller 303 is rotated by a drive unit (not shown). Toner, which has been charged to coat the surface of developing roller 303, adheres along the electrostatic latent image on the surface of the photosensitive drum 301, to thereby cause the electrostatic latent image to become a visible image. In the following description, the visible image based on the toner is referred to as "toner image".

A base layer of the photosensitive drum 301 is grounded, and a voltage having a polarity reverse to that of the toner is applied to the primary transfer roller 206 by a high-voltage power supply (not shown). Therefore, a transfer electric field is formed at a nip portion formed between the primary transfer roller 206 and the photosensitive drum 301, and the toner image is transferred from the photosensitive drum 301 onto the intermediate transfer belt 205. The toner remaining on the surface of the photosensitive drum 301 that are not transferred onto the intermediate transfer belt 205 is removed from the photosensitive drum 301 by a drum cleaning blade 304 to be collected in a waste toner container 305.

The intermediate transfer belt 205 rotates in the direction indicated by the arrow A, to thereby cause toner images generated in the image forming stations S of the respective colors to be sequentially transferred in superimposition onto the intermediate transfer belt 205. Then, a full-color toner image is formed and conveyed. The intermediate transfer belt 205 is driven by an opposing roller (drive roller) 217. A rotation-axis direction of the opposing roller 217 can be referred to as a rotation-axis direction of the intermediate transfer belt 205.

The recording materials 203 are stacked in a sheet feeding cassette 208. Sheet feeding rollers 209 are driven based on a sheet feeding start signal, to thereby feed each of the recording materials 203 to a conveyance path. The recording material 203 is conveyed so as to reach, via a registration roller pair 210, an abutment nip portion (hereinafter also referred to as "secondary transfer portion") formed between a secondary transfer roller 211 being a transfer member and a secondary transfer opposing roller 212 at a predetermined timing. Specifically, the recording material 203 is conveyed so that a leading edge portion of the toner image on the intermediate transfer belt 205 and a leading edge portion of the recording material 203 meet each other at a predetermined timing.

While the recording material 203 is nipped and conveyed between the secondary transfer roller 211 and the secondary transfer opposing roller 212, a voltage having a polarity reverse to that of the toner is applied to the secondary transfer roller 211 from a power supply apparatus (not shown). The secondary transfer opposing roller 212 is grounded, and hence a transfer electric field is formed between the secondary transfer roller 211 and the secondary transfer opposing roller 212. This transfer electric field causes the toner image to be transferred from the intermediate transfer belt 205 onto the recording material 203.

After passing through the nip portion between the secondary transfer roller 211 and the secondary transfer opposing roller 212, the recording material 203 is subjected to heating and pressurizing processing by a fixing device 213. This causes the toner image on the recording material 203 which is not fixed to be fixed to the recording material 203. After that, the recording material 203 is conveyed from an outlet 214 to a delivery tray 215, and thus the process of image formation is completed.

Meanwhile, the toner on the intermediate transfer belt 205 that is not transferred by the secondary transfer portion is removed from the intermediate transfer belt 205 by a cleaning member 216, and the intermediate transfer belt 205 is refreshed (cleaned) to a state that allows the image formation again. As the cleaning member 216, for example, a cleaning blade formed of an elastic body is employed. The cleaning member 216 is pressed in abutment against the intermediate transfer belt 205. The intermediate transfer belt 205 rotates while the cleaning member 216 stops. Thus, an abutment surface of the intermediate transfer belt 205 against the cleaning member 216 is rubbed by the cleaning member 206. The rubbing by the cleaning member 216 causes the toner that remains on the intermediate transfer belt 205 to be scraped off.

Further, a user can access the process cartridge 204 by opening an access door (not shown) of the image forming apparatus 200. The user can remove the process cartridge 204 from the image forming apparatus 200 by opening the access door and drawing the process cartridge 204 toward the near side of FIG. 1. Further, the user can mount the process cartridge 204 to the image forming apparatus 200.

The image forming apparatus 200 detects whether or not the process cartridge 204 (or the photosensitive drum 301) is mounted, and displays, on a display unit 230, a message for notifying a mounting state. Further, the image forming apparatus 200 includes a density sensor 218, which is described later, and the opposing roller 217.

(Configuration of Intermediate Transfer Belt)

Figure 2:
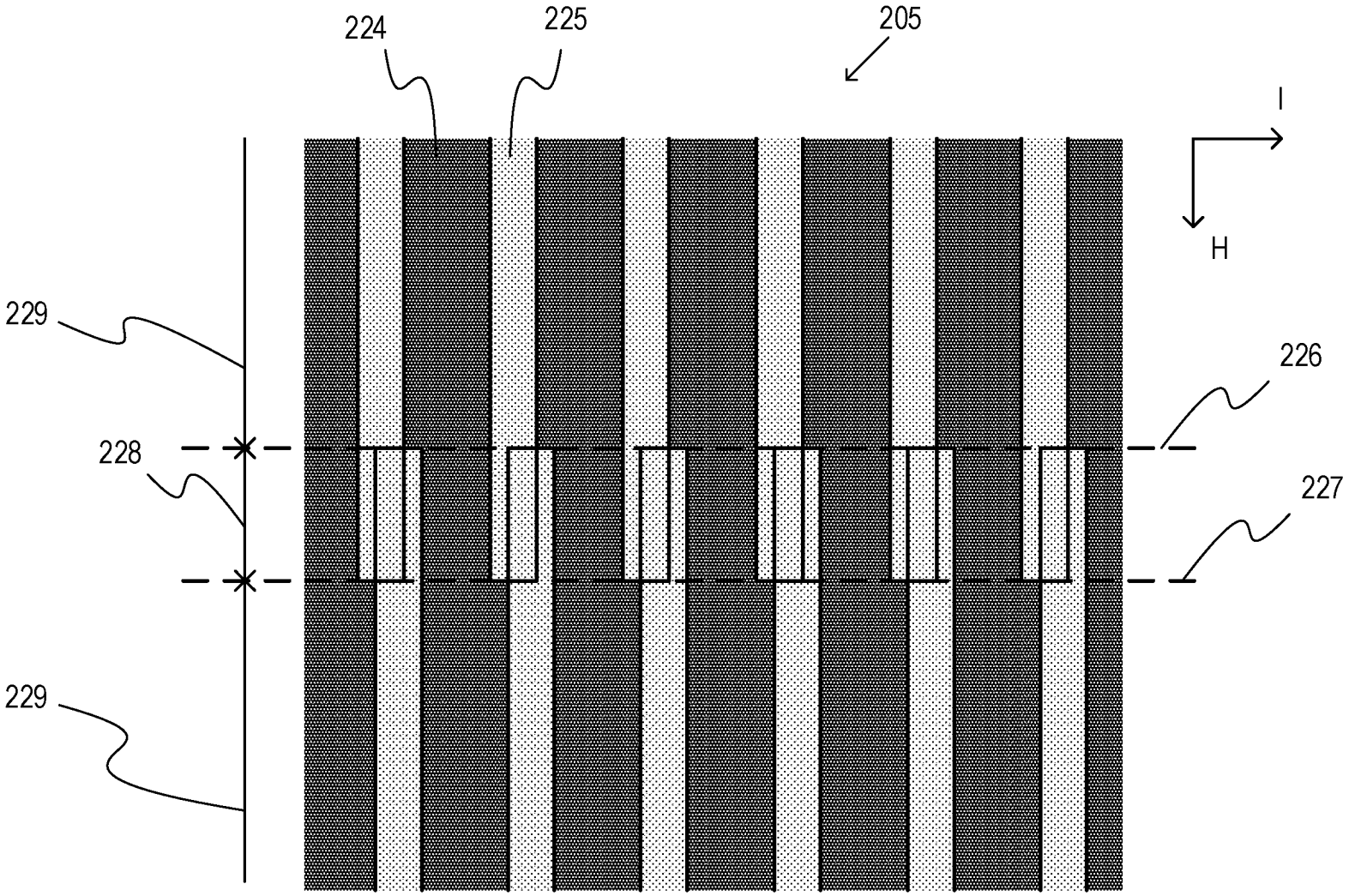
FIG. 2 is an enlarged schematic view of an intermediate transfer belt of the first embodiment to the third embodiment.

FIG. 2 is an enlarged schematic explanatory view for illustrating a part of a surface of the intermediate transfer belt 205. In order to improve wear resistance of a surface of the cleaning member 216, the intermediate transfer belt 205 of the first embodiment has, on the surface of the intermediate transfer belt 205, a fine recesses and protrusions surface profile (hereinafter referred to as "fine recesses and protrusions surface profile"). As methods for processing the fine recesses and protrusions surface profile, in general, grinding, machining, and imprinting are known. In the configuration of the first embodiment, for example, the imprinting is employed in view of processing cost, productivity, and profile accuracy.

The imprinting is performed by pressing an imprinting die (not shown) against the surface of the intermediate transfer belt 205 and thereafter moving the intermediate transfer belt 205 in a rotary direction (rotation direction or moving direction) H. In this embodiment, recessed portions 225 are formed on the surface of the intermediate transfer belt 205 by the imprinting die. The rotary direction H is the same as a rotary direction (rotation direction or moving direction) A of the intermediate transfer belt 205 in a state in which the intermediate transfer belt 205 is mounted to the image forming apparatus 200.

In the intermediate transfer belt 205 having been subjected to the imprinting, the recessed portions 225 extending in the rotary direction H are cyclically arranged in an I-direction that is orthogonal to the rotary direction H. Protruded portions 224 are each arranged between adjacent recessed portions 225. The protruded portions 224 are portions of the surface of the intermediate transfer belt 205 at which the recessed portions 225 are not formed. The protruded portions 224 also extend in the rotary direction H. That is, a plurality of recessed portions 225 and a plurality of protruded portions 224 are arranged in the I-direction. In the I-direction, the recessed portions 225 and the protruded portions 224 are arranged alternately. It is preferred that the recessed portions 225 and the protruded portions 224 extend in parallel with the rotary direction H of the intermediate transfer belt 205. It is preferred that, at an overlapping portion 228 described later, a starting end and a terminating end of one recessed portion 225 overlap each other in the I-direction.

The imprinting is started from a starting position 226 to a terminating position 227 along the rotary direction H. In the rotary direction H, the recessed portions 225 and the protruded portions 224 are formed over an entire periphery of the intermediate transfer belt 205. Thus, the terminating position 227 of the imprinting is located at a position beyond the starting position 226. As a result, an imprint overlapping portion (hereinafter simply referred to as "overlapping portion") 228 being a second portion serving as an optically singular region described later is formed. A portion of the intermediate transfer belt 205 in the rotary direction H other than the overlapping portion 228, that is, a first portion that does not overlap is referred to as "non-overlapping portion 229." In view of processing, a length of the overlapping portion 228 varies within a range of, for example, from 3 mm to 25 mm.

In the I-direction, a position of the recessed portion 225 at the starting position 226 and a position of the recessed portion 225 at the terminating position 227 are misaligned at high possibility. As a result, at the overlapping portion 228, positions of the recessed portions 225 are misaligned in the I-direction. This is caused by movement of the intermediate transfer belt 205 in the I-direction during the imprinting. When such misalignment occurs, in the I-direction, a ratio of the protruded portions 224 at the overlapping portion 228 is reduced as compared to that given at the non-overlapping portion 229, and a ratio of the recessed portions 225 increases. Further, the imprinting is performed twice at the overlapping portion 228. Thus, the depth of the recessed portions 225 becomes larger than that given at the non-overlapping portion 229.

Due to the reasons described above, at the overlapping portion 228, the amount of reflected light in a specular reflection direction at the time of irradiation with light is reduced as compared to that given at the non-overlapping portion 229. That is, the optical characteristic of the overlapping portion 228 is different from the optical characteristic of the non-overlapping portion 229.

The depth of the recessed portions 225 is significantly small with respect to the layer thickness of the intermediate transfer belt 205. Thus, there is no difference in transfer performance of the toner image between the overlapping portion 228 and the non-overlapping portion 229.

(Configuration of Density Sensor)

Figure 3A:
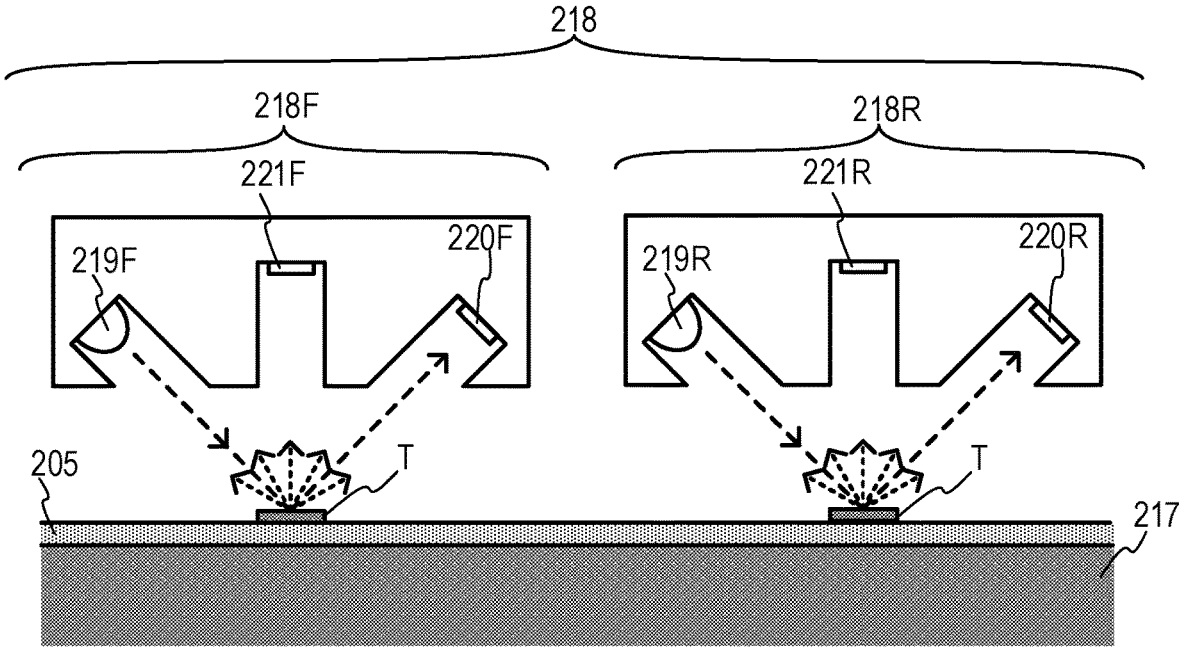
FIG. 3A is a schematic explanatory view for illustrating a density sensor of the first embodiment to the third embodiment.

FIG. 3A is a schematic configuration view of the density sensor 218 being a toner detection unit configured to detect presence or absence of toner, and is a sectional view taken along a direction orthogonal to the rotary direction of the intermediate transfer belt 205 at a position at which the density sensor 218 is arranged. The density sensor 218 is capable of optically detecting the presence or absence of toner on the intermediate transfer belt 205.

After having been transferred onto the surface of the intermediate transfer belt 205 in the image forming station S, a toner image is carried to the position of the opposing roller 217 in accordance with the rotation of the intermediate transfer belt 205. The density sensor 218 is arranged on a side opposite to the opposing roller 217 across the intermediate transfer belt 205.

The density sensor 218 is formed of two sensor units, that is, a sensor unit 218F and a sensor unit 218R. In the following description, the sensor unit 218F is referred to as "density sensor 218F," and the sensor unit 218R is referred to as "density sensor 218R." The density sensors 218R and 218F are arranged at positions apart by the same distance from a center of the intermediate transfer belt 205 in a direction orthogonal to the rotation direction of the intermediate transfer belt 205 (hereinafter referred to as "longitudinal direction"). The direction orthogonal to the rotation direction of the intermediate transfer belt 205 is the same as the rotation-axis direction of the intermediate transfer belt 205. That is, the density sensor 218 includes the density sensor 218F being a first detection unit arranged at a first detection position in the direction orthogonal to the rotation direction of the intermediate transfer belt 205 and the density sensor 218R being a second detection unit arranged at a second detection position. In the following, a configuration of the density sensor 218 is described with the density sensor 218F as an example.

The density sensor 218 includes an irradiation portion configured to irradiate the surface of the intermediate transfer belt 205 with light and a light receiving portion configured to receive reflected light, and is configured to optically detect the intermediate transfer belt 205 or image patterns described later. Specifically, the density sensor 218F is mainly formed of a light emitting element 219F, a specularly-reflected-light receiving element 220F, and a diffusely-reflected-light receiving element 221F. The light emitting element 219F emits infrared light, and the infrared light is reflected by the surface of the toner image T. The specularly-reflected-light receiving element 220F is arranged in a specular reflection direction with respect to the position of the toner image T, and detects light specularly reflected at the position of the toner image T. The diffusely-reflected-light receiving element 221F is arranged at a position other than a position in the specular reflection direction with respect to the toner image T, and detects light diffusely reflected at the position of the toner image T. Voltage values having been respectively detected are referred to as "specular reflection output" and "diffused reflection output."

Figure 3B:
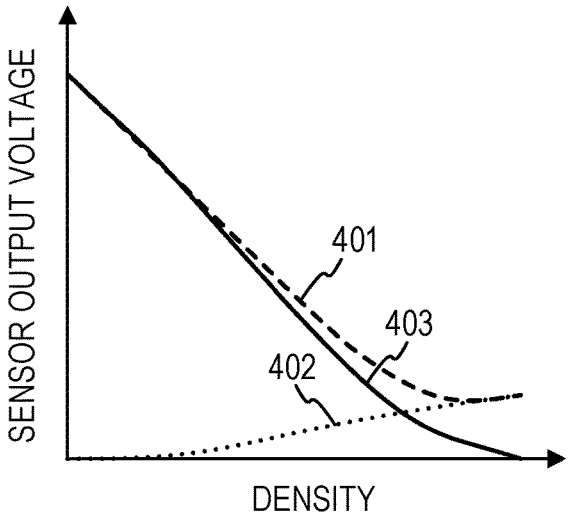
FIG. 3B is a schematic explanatory graph for showing an output voltage of the first embodiment to the third embodiment.

FIG. 3B is a schematic explanatory graph for showing a change in specular reflection output and a change in diffused reflection output with respect to the density, and a change in output voltage calculated based on those changes. In the graph of FIG. 3B, the horizontal axis represents the density, and the vertical axis represents the output voltage of the density sensor 218 (sensor output voltage). Further, the specular reflection output is indicated by a broken line 401, the diffused reflection output is indicated by a dot line 402, and output of the density sensor 218 (sensor output) is indicated by a solid line 403.

When the toner amount of a toner image T is small, reflection from the smooth surface of the intermediate transfer belt 205 is significantly detected, and hence the specular reflection output becomes larger. As the toner of the toner image T increases, the specular reflection output becomes smaller. When the number of toner layers of the toner image T is equal to or larger than one, a specular reflection component from the surface of the intermediate transfer belt 205 is substantially lost. However, the specular reflection output also includes a diffused reflection component in addition to the specular reflection component, and hence the specular reflection output does not decrease monotonously in a region with high density. Meanwhile, the diffused reflection output increases monotonously in accordance with the toner amount, but the amount of change is smaller as compared to that of the specular reflection output. The output having a correlation with the density (solid line 403) can be obtained by removing the diffused reflection component, which is obtained based on the diffused reflection output, from the specular reflection output. The solid line 403 is referred to as "sensor output change."

Figure 4A:
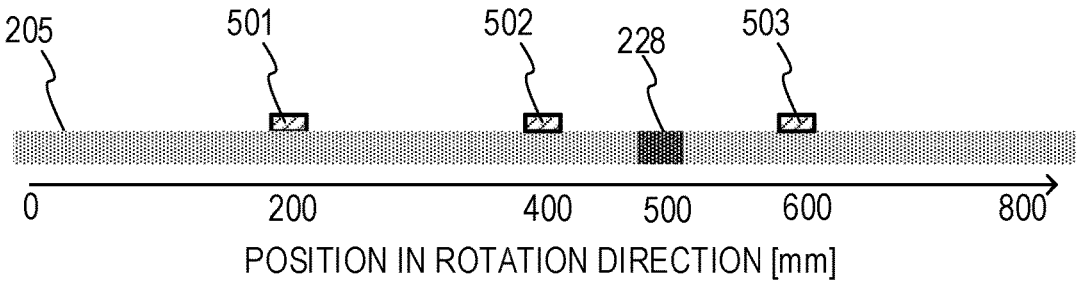
FIG. 4A shows toner images formed at a plurality of positions on the intermediate transfer belt of the first embodiment to the third embodiment.

FIG. 4A is a schematic explanatory view for illustrating a state in which toner images are formed at a plurality of positions on the intermediate transfer belt 205 inside the image forming apparatus 200. An arrow of FIG. 4A indicates a position (rotation direction position) [mm] in the rotary direction (hereinafter also referred to as "rotation direction") of the intermediate transfer belt 205, and a position being a reference on the intermediate transfer belt 205 (hereinafter referred to as "reference position") corresponds to a position of 0 mm.

A toner image 501, a toner image 502, and a toner image 503 are formed at equal intervals in the rotation direction of the intermediate transfer belt 205. For example, the toner image 501 is formed at a position apart from the reference position by a distance of 200 mm. The toner image 502 is formed at a position apart from the reference position by 400 mm and apart from the toner image 501 by 200 mm. The toner image 503 is formed at a position apart from the reference position by 600 mm and apart from the toner image 502 by 200 mm.

When the toner image 501, the toner image 502, and the toner image 503 are formed, the overlapping portion 228 may be located at a position among the toner images 501, 502, and 503. For example, the overlapping portion 228 may be located at a position between the toner image 502 and the toner image 503, that is, between the position apart from the reference position by 400 mm and the position apart from the reference position by 600 mm. In FIG. 4A, the overlapping portion 228 is located at, for example, a position apart from the reference position by 500 mm.

Figure 4B:
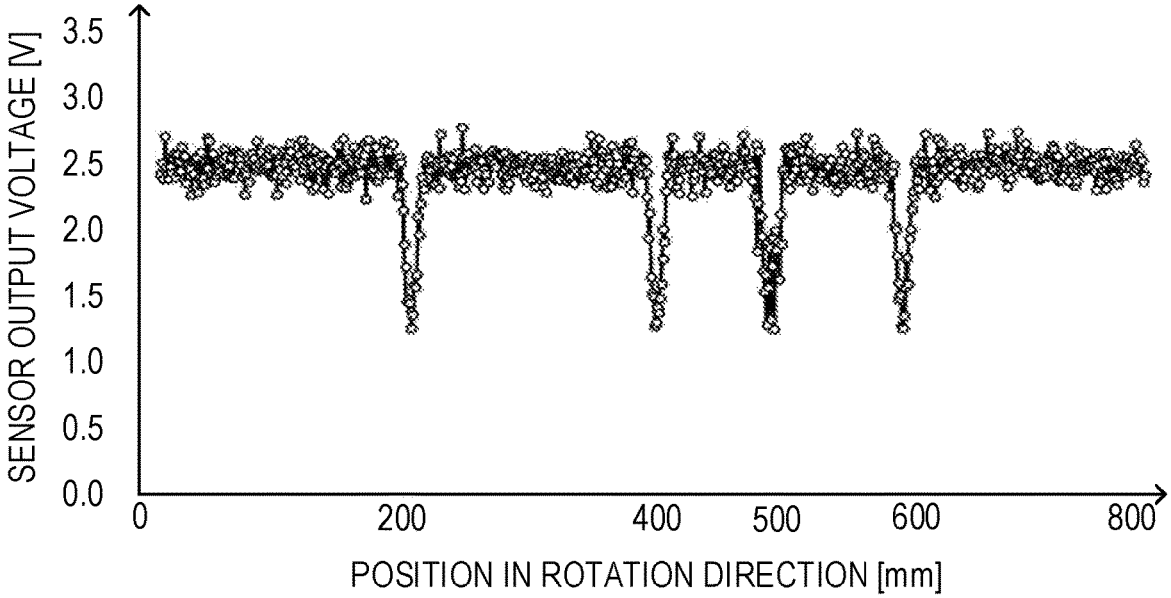
FIG. 4B is a detailed explanatory graph for showing an output voltage of a specularly-reflected-light receiving element of the first embodiment to the third embodiment.

FIG. 4B shows the output voltage (sensor output voltage) of the density sensor 218 in the state of FIG. 4A. In FIG. 4B, the horizontal axis represents a position [mm] in the rotation direction of the intermediate transfer belt 205, and the vertical axis represents the sensor output voltage [V]. The horizontal axis of FIG. 4B corresponds to the horizontal axis of FIG. 4A.

The sensor output decreases around the positions of 200 mm, 400 mm, and 600 mm at which the toner images are formed. Further, the sensor output also decreases around the position of 500 mm corresponding to the position of the overlapping portion 228. The sensor output voltage is about 2.5 V in the entire periphery of the intermediate transfer belt 205 except for the portions at which the toner images 501, 502, and 503 are formed and the portion at which the overlapping portion 228 is present. Meanwhile, the sensor output voltage drops to about 1.3 V at the positions of the toner images 501, 502, and 503 and at the position of the overlapping portion 228.

That is, in the case of FIG. 4A, it cannot be judged whether the decrease in voltage is caused by the toner images or the overlapping portion 228 by only referring to the values of the sensor output voltage shown in FIG. 4B. The sensor output voltage at the overlapping portion 228 is dependent on a ratio of the recessed portions 225 and a depth of the recessed portions 225, and therefore changes due to variation that occurs at the time of the imprinting.

(Hardware Block Diagram)

Figure 5:
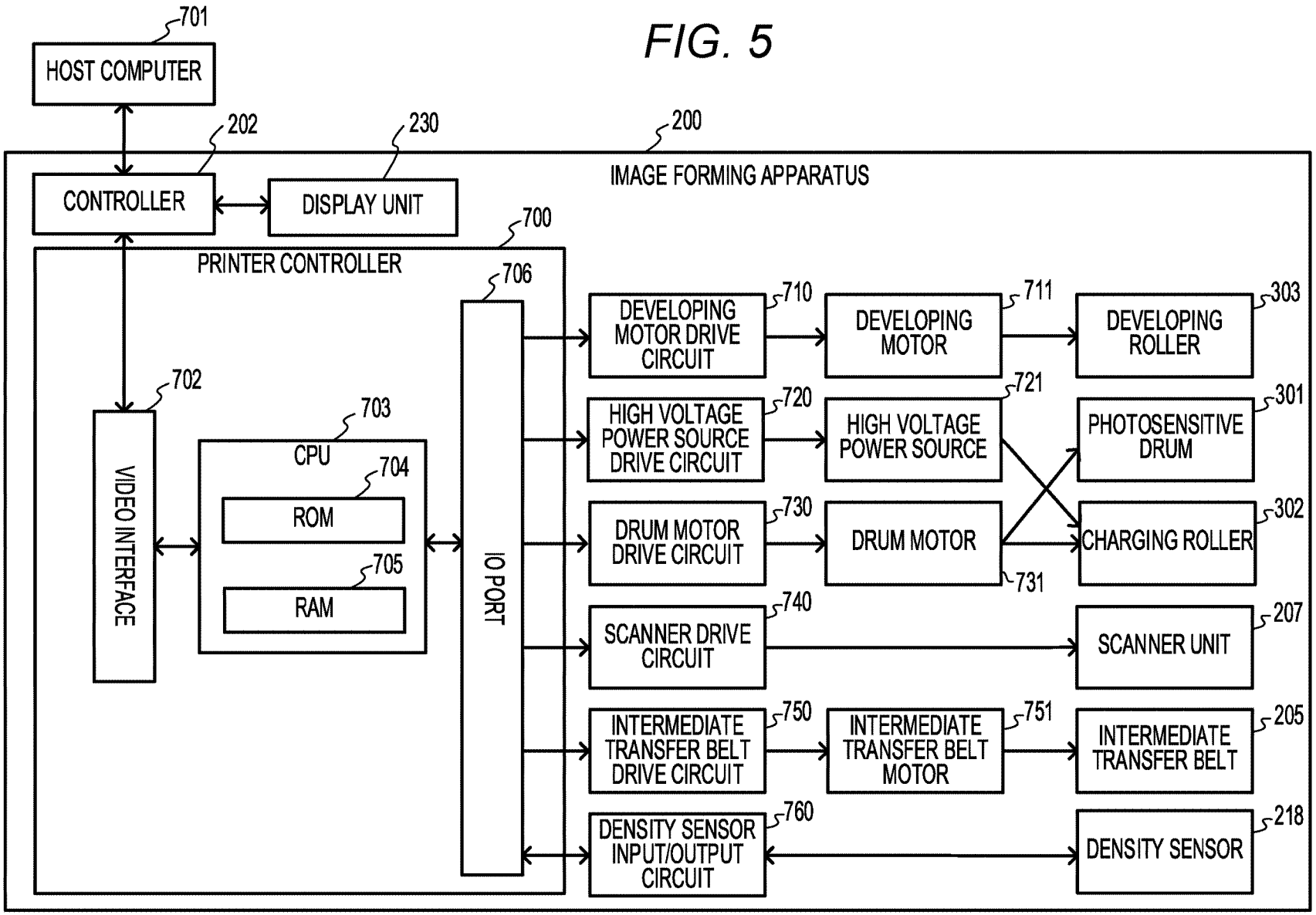
FIG. 5 is a hardware configuration diagram of the first embodiment to the third embodiment.

FIG. 5 is a hardware block diagram of the image forming apparatus 200 according to the first embodiment.

A printer controller 700 is formed of a circuit of, for example, a CPU 703, a ROM 704, a RAM 705, and a video interface 702, and executes a program for controlling devices provided in the image forming apparatus 200.

The controller 202 is connected to the printer controller 700 via the video interface 702, and, for example, instructs the printer controller 700 to start image forming in accordance with setting of a host computer 701 via a network, a printer cable or the like. In accordance with a print command from the host computer 701, the controller 202 transmits an image formation reservation command to the printer controller 700 via the video interface 702. The controller 202 transmits an image formation start command to the printer controller 700 at a timing at which an image can be formed.

The controller 202 and the display unit 230 can communicate with each other. The display unit 230 displays a message indicated by the printer controller 700. The printer controller 700 performs preparation for executing image forming in the order of image formation reservation commands from the controller 202, and then waits for the image formation start command from the controller 202. When the image formation start command is received, the printer controller 700 outputs, to the controller 202, a TOP signal (Top Of Page signal) serving as a reference timing for output of a video signal, and starts a printing operation in accordance with the image formation reservation command.

Next, actuators connected to the CPU 703 are described. A developing motor drive circuit 710, a high voltage power source drive circuit 720, a drum motor drive circuit 730, a scanner drive circuit 740, an intermediate transfer belt drive circuit 750, and a density sensor input/output circuit 760 are connected to the CPU 703 via an IO port 706.

The developing motor drive circuit 710 drives a developing motor 711 to rotate the developing roller 303. The high voltage power source drive circuit 720 drives a high voltage power source 721 to apply a high voltage to the charging roller 302 and the primary transfer roller 206 (not shown in FIG. 5). The drum motor drive circuit 730 drives a drum motor 731 to rotate the photosensitive drum 301 and the charging roller 302. The scanner drive circuit 740 drives the scanner unit 207 to irradiate the surface of the photosensitive drum 301 with laser light. The intermediate transfer belt drive circuit 750 drives an intermediate transfer belt motor 751 to rotate the intermediate transfer belt 205.

The density sensor input/output circuit 760 causes the light emitting element 219 of the density sensor 218 to emit light, and receives the specularly reflected light and the diffusedly reflected light with the specularly-reflected-light receiving element 220 and the diffusely-reflected-light receiving element 221, respectively. The received light is converted to voltage values by the density sensor input/output circuit 760, and the voltage values are input as the specular reflection output and the diffused reflection output to the CPU 703 via the IO port 706.

(Function Block Diagram)

Figure 6A:
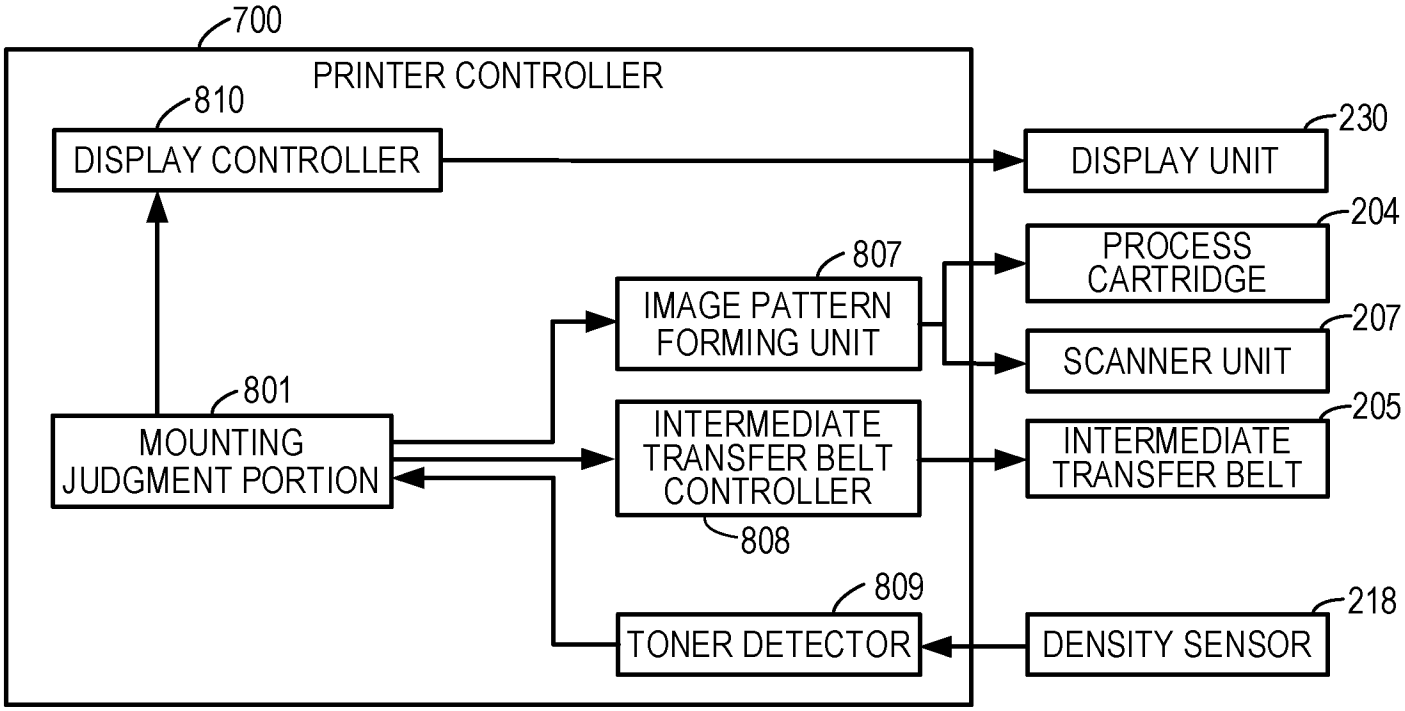
FIG. 6A is a function block diagram of the first embodiment.

Functions of the printer controller 700 are described with reference to a function block diagram of FIG. 6A. The functions of the printer controller 700 are executed by the CPU 703 based on a program stored in the ROM 704 and data stored in the RAM 705.

Details of the functions are described one by one. An image pattern forming unit 807 controls the process cartridge 204 and the scanner unit 207. The image pattern forming unit 807 drives the process cartridge 204 and the scanner unit 207 to transfer a toner image of an image pattern, which is described later, to the intermediate transfer belt 205. The image pattern forming unit 807 functions as a forming unit configured to form an image pattern including at least one toner image on the surface of the intermediate transfer belt 205. An intermediate transfer belt controller 808 rotates the intermediate transfer belt 205. A toner detector 809 acquires the sensor output [V] that is obtained by removing the diffused reflection component from the specular reflection output of the density sensor 218.

(Image Pattern)

Figure 6B:
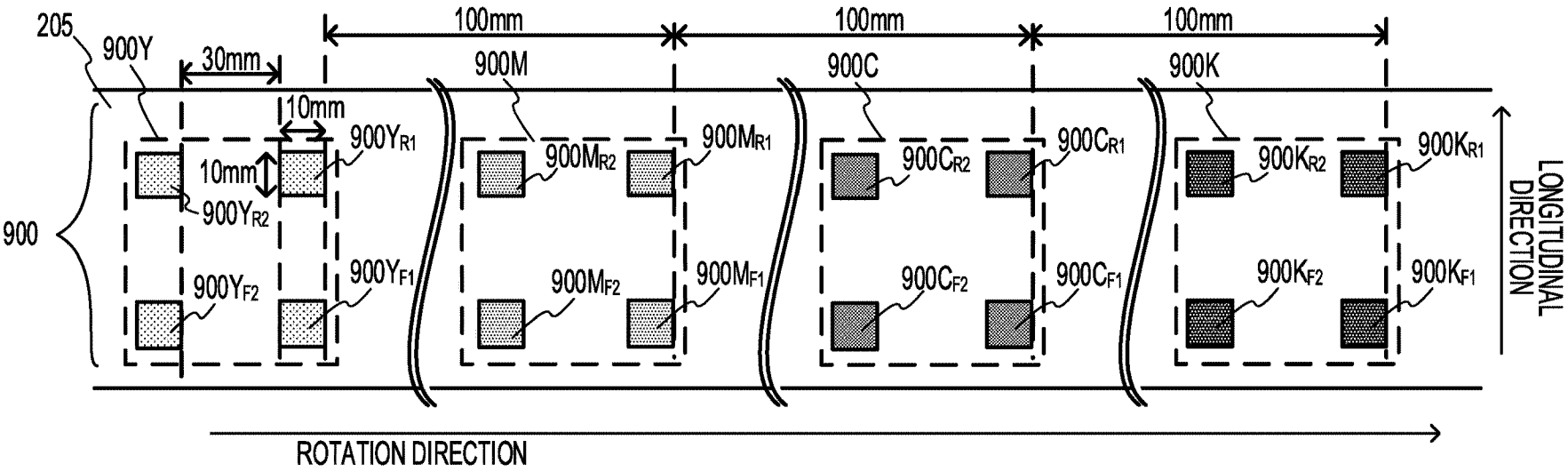
FIG. 6B is a schematic explanatory view for illustrating an image pattern of the first embodiment.

FIG. 6B shows an image pattern formed by the image pattern forming unit 807. An arrow indicates the rotation direction of the intermediate transfer belt 205, and the intermediate transfer belt 205 is seen from above. Further, in FIG. 6B, the longitudinal direction (rotation-axis direction of the intermediate transfer belt 205) is also indicated by an arrow. An image pattern 900 includes image patterns 900Y, 900M, 900C, and 900K of respective colors.

In the state in which the process cartridge 204 is mounted to the image forming apparatus 200, the image pattern forming unit 807 controls the scanner unit 207 to allow the scanner unit 207 to perform an exposure operation, thereby forming the image pattern 900.

The image pattern 900Y is an image pattern including four toner images being detection images (detection toner images), specifically, a toner image $\mathbf{900}Y_{F1}$, a toner image $\mathbf{900}Y_{R1}$, a toner image $\mathbf{900}Y_{F2}$, and a toner image $\mathbf{900}Y_{R2}$. The toner image $\mathbf{900}Y_{F1}$, the toner image $\mathbf{900}Y_{R1}$, the toner image $\mathbf{900}Y_{F2}$, and the toner image $\mathbf{900}Y_{R2}$ are each a square having a size of 10 $mm^2$.

Further, positions of the toner image $\mathbf{900}Y_{F1}$ and the toner image $\mathbf{900}Y_{F2}$ in the longitudinal direction are positions at which the toner image $\mathbf{900}Y_{F1}$ and the toner image $\mathbf{900}Y_{F2}$ can be detected by the density sensor 218F. Positions of the toner image $\mathbf{900}Y_{R1}$ and the toner image $\mathbf{900}Y_{R2}$ in the longitudinal direction are positions at which the toner image $\mathbf{900}Y_{R1}$ and the toner image $\mathbf{900}Y_{R2}$ can be detected by the density sensor 218R.

In other words, the image pattern 900 includes two toner images ($\mathbf{900}Y_{F1}$ and $\mathbf{900}Y_{F2}$) arranged in the rotation direction of the intermediate transfer belt 205 and two toner images ($\mathbf{900}Y_{R1}$ and $\mathbf{900}Y_{R2}$) arranged in the rotation direction of the intermediate transfer belt 205. In the rotation direction of the intermediate transfer belt 205, an interval between the toner image 900$Y_{F2}$ and the toner image 900$Y_{F1}$ and an interval between the toner image $Y_{R2}$ and the toner image 900$Y_{R1}$ are each 30 mm. Here, the interval corresponds to an interval between a trailing edge of a predetermined toner image and a leading edge of a toner image formed next to the predetermined toner image in the rotation direction of the intermediate transfer belt 205.

The image patterns 900M, 900C, and 900K also have the same size and positional relationship as those of the image pattern 900Y. Thus, description thereof is omitted, and corresponding reference symbols are given in FIG. 6B. Intervals of respective leading edge positions of the image patterns 900Y, 900M, 900C, and 900K are each 100 mm. Such distance is the same as the distance between photosensitive drums 301 of respective colors. When formation of the toner images of all the respective colors is started simultaneously, the image patterns 900Y, 900M, 900C, and 900K are formed on the surface of the intermediate transfer belt 205 at the intervals of 100 mm. Information of the positions and sizes of the image patterns is stored in the ROM 704 in advance.

Here, a pattern formed by a toner image being one of two toner images of the same color arranged in the rotation direction that arrives at the density sensor 218 ahead is referred to as "first pattern." That is, the first pattern is a pattern formed by the toner images denoted by the reference symbols with the subscript "1" in FIG. 6B. A pattern formed by a toner image being one of the two toner images of the same color arranged in the rotation direction that arrives at the density sensor 218 later is referred to as "second pattern." That is, the second pattern is a pattern formed by the toner images denoted by the reference symbols with the subscript "2" in FIG. 6B.

For example, in the image pattern 900Y, the first pattern includes a plurality of first toner images (toner image 900$Y_{F1}$ and toner image 900$Y_{R1}$) arranged in the direction orthogonal to the rotation direction of the intermediate transfer belt 205. The second pattern includes a plurality of second toner images (toner image 900$Y_{F2}$ and toner image 900$Y_{R2}$) arranged in the direction orthogonal to the rotation direction of the intermediate transfer belt 205.

As described later, when any one of the plurality of first toner images is detected by the density sensor 218, and any one of the plurality of second toner images is detected by the density sensor 218, a mounting judgment portion 801 judges that the process cartridge 204 is mounted. Further, when all of the plurality of first toner images are not detected, or all of the plurality of second toner images are not detected, the mounting judgment portion 801 judges that the process cartridge 204 is not mounted.

The image pattern forming unit 807 controls the scanner unit 207 such that the scanner unit 207 performs a first exposure operation and, after elapse of a predetermined time period from the first exposure operation, a second exposure operation. The image pattern 900 is formed on the surface of the intermediate transfer belt 205 through the first exposure operation and the second exposure operation.

When the process cartridge 204 is mounted to the image forming apparatus 200, the first pattern is formed through the first exposure operation, and the second pattern is formed through the second exposure operation. The second pattern is formed apart from the first pattern by a predetermined interval in the rotation direction of the intermediate transfer belt 205. In a case in which the process cartridge 204 is not mounted to the image forming apparatus 200, even when the first exposure operation and the second exposure operation are performed, the first pattern and the second pattern are not formed on the intermediate transfer belt 205.

Here, the predetermined interval mentioned above is longer than the length of the overlapping portion 228 in the rotation direction of the intermediate transfer belt 205. That is, the predetermined time period mentioned above is longer than a time period that is obtained by dividing the length of the overlapping portion 228 in the rotation direction of the intermediate transfer belt 205 by the movement speed of the surface of the intermediate transfer belt 205.

Now, description is made with reference to FIG. 6A again. The mounting judgment portion 801 forms the image pattern 900 on the surface of the intermediate transfer belt 205, and judges whether or not the process cartridge 204 is mounted based on the output of the density sensor 218. The mounting judgment portion 801 functions as a judgment unit configured to judge a mounting state of the photosensitive drum 301 based on a result of detection by the density sensor 218 after the image pattern forming unit 807 performs the operation of forming the image pattern on the surface of the intermediate transfer belt 205. A display controller 810 displays a message indicating a mounting state on the display unit 230 based on a judgment result of the mounting judgment portion 801.

(Mounting Judgment Portion 801)

The mounting judgment for the process cartridge 204 by the mounting judgment portion 801 is described with reference to flowcharts of FIG. 7 and FIG. 8.

The mounting judgment portion 801 starts the processing of the step (hereinafter described as "Step S") 101 and the subsequent steps of FIG. 7 at a timing at which the access door (not shown) is closed.

In Step S101, the mounting judgment portion 801 rotates the intermediate transfer belt 205 with the intermediate transfer belt controller 808 such that the movement speed of the surface of the intermediate transfer belt 205 becomes, for example, 80 mm/sec. In Step S102, the mounting judgment portion 801 starts to form the image pattern 900 with the image pattern forming unit 807. In Step S103, the mounting judgment portion 801 initially sets black (K) as a color for judging whether or not the process cartridge 204 is mounted (hereinafter referred to as "judgment color"). Setting the judgment color to black (K) is hereinafter also referred to as "initializing the judgment color." Thus, the processing of Step S103 is the processing of initializing the judgment color to black (K).

In Step S104, the mounting judgment portion 801 judges a mounting state of the process cartridge 204 of the judgment color. The processing of Step S104 is described in detail with reference to FIG. 8.

In Step S105, the mounting judgment portion 801 updates the judgment color to next color (color other than black). The order of updating the judgment color corresponds to the order of toner images that arrive at the density sensor 218. In the case of FIG. 6B, the judgment color is updated in the order of K, C, M, Y.

In Step S106, the mounting judgment portion 801 judges whether or not judgments for mounting states of the process cartridges 204 of all colors have been completed (mounting judgment has been terminated). In Step S106, when the mounting judgment portion 801 judges that the judgments for all colors have not been completed, the processing returns to Step S104. When the mounting judgment portion 801 judges that the judgments for all colors have been completed, the processing proceeds to Step S107.

In Step S107, the mounting judgment portion 801 stops the intermediate transfer belt 205 with the intermediate transfer belt controller 808. In Step S108, the mounting judgment portion 801 displays a message that is based on the judgment result of the mounting state of the process cartridge 204 judged in Step S104 on the display unit 230 with the display controller 810. Then, the processing of FIG. 7 is terminated.

For example, when it is judged that the process cartridge 204 is not mounted according to the judgment of Step S104, the display controller 810 displays, on the display unit 230, information of the process cartridge 204 that is not mounted, to thereby urge a user to mount the process cartridge 204. Further, for example, when it is judged that all of the process cartridges 204 are mounted according to the judgment of Step S104, the display controller 810 may display, on the display unit 230, an indication that image forming can be performed by the image forming apparatus 200.

(Judgment Processing for Mounting State)

Figure 7:
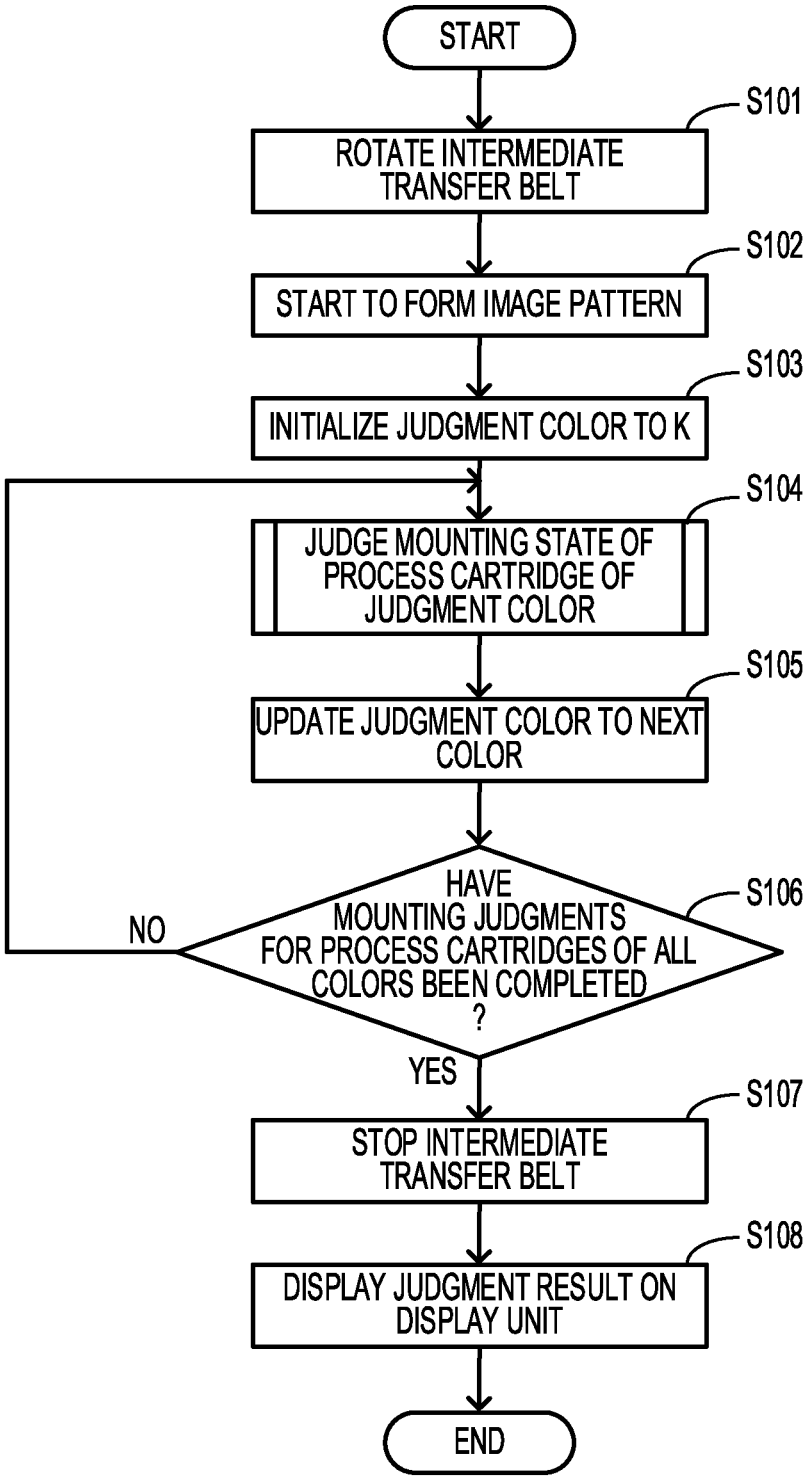
FIG. 7 is a flowchart for illustrating mounting judgment processing of the first embodiment.
Figure 8:
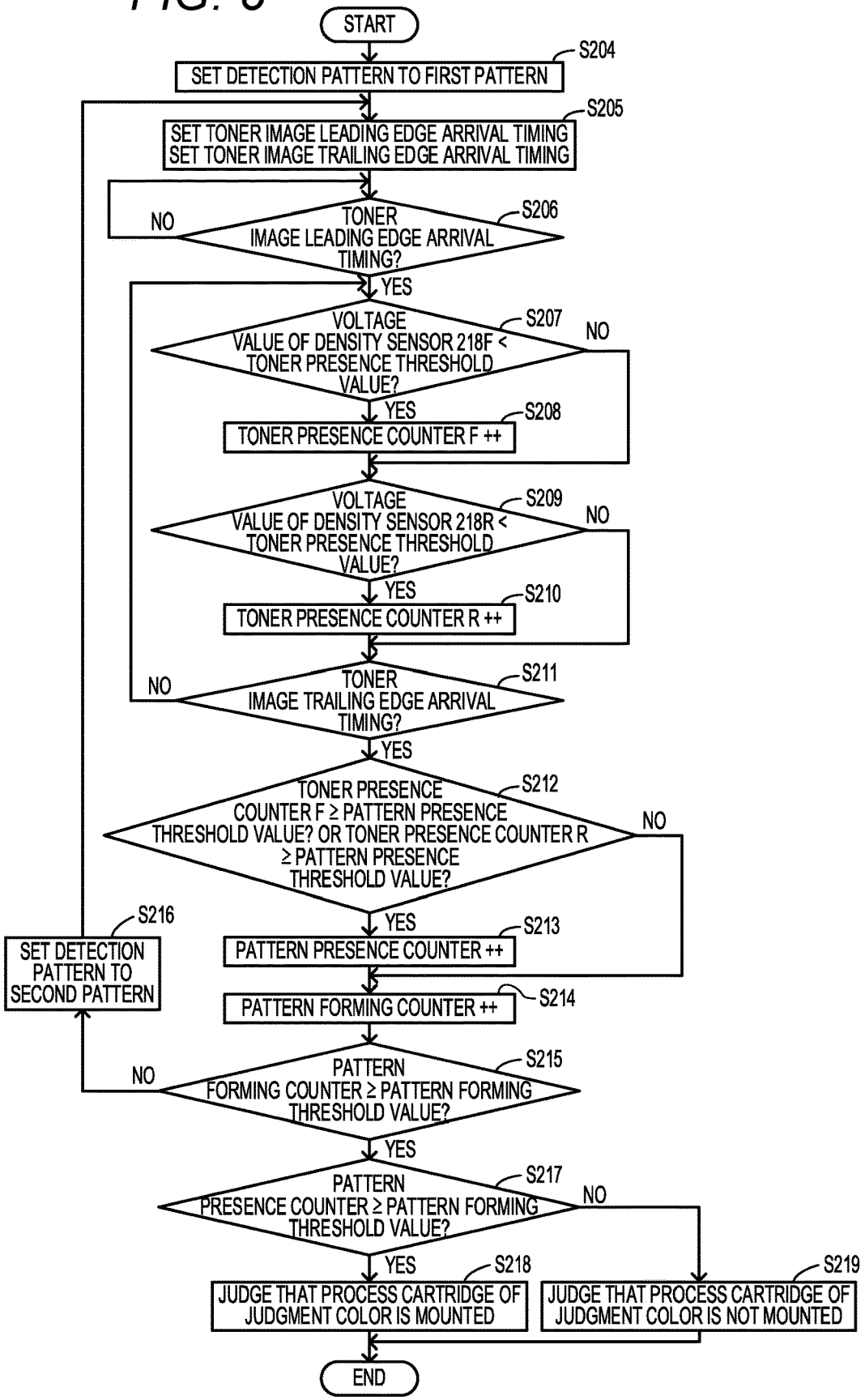
FIG. 8 is a flowchart for illustrating the mounting judgment processing of the first embodiment.

The flowchart of FIG. 8 shows the processing executed in Step S104 of FIG. 7.

The mounting judgment portion 801 includes a rotation counter for managing movement (rotary motion, rotation) of the intermediate transfer belt 205.

Further, the mounting judgment portion 801 includes a toner presence counter for performing a counting operation when it is judged that the toner is present on the intermediate transfer belt 205 based on the detection result (sensor output) of the density sensor 218. The density sensor 218 includes the density sensor 218F and the density sensor 218R. Thus, the toner presence counter includes a toner presence counter F and a toner presence counter R corresponding to the respective units.

Further, the mounting judgment portion 801 includes a pattern presence counter for judging whether or not an image pattern is present on the intermediate transfer belt 205. Further, the mounting judgment portion 801 includes a pattern forming counter for managing the image forming operation performed by the image pattern forming unit 807. Those counters are initialized to 0 before the start of the processing.

In the flowchart of FIG. 8, the mounting judgment portion 801 increments the rotation counter, for example, in a cycle of 2 milliseconds (hereinafter referred to as "ms"). In Step S204, the mounting judgment portion 801 sets a detection pattern that is to be detected by the density sensor 218 to the first pattern. As mentioned above, the first pattern is the pattern formed by the toner images being one of the two patterns of the same color arranged in the rotation direction that arrives at the density sensor 218 ahead as described with reference to FIG. 6B (toner images denoted by the reference symbols with the subscript "1" in FIG. 6B). Further, as mentioned above, the pattern formed by the toner images being one of the two toner images of the same color arranged in the rotation direction that arrives at the density sensor 218 later as described with reference to FIG. 6B is referred to as the "second pattern." That is, the second pattern is the pattern formed by the toner images denoted by the reference symbols with the subscript "2" in FIG. 6B.

In Step S205, the mounting judgment portion 801 sets a timing at which the leading edge of the toner image arrives at the position of the density sensor 218 and a timing at which the trailing edge of the toner image arrives at the position of the density sensor 218. The timing at which the leading edge of the toner image arrives at the position of the density sensor 218 is hereinafter referred to as "toner image leading edge arrival timing," and the timing at which the trailing edge of the toner image arrives at the position of the density sensor 218 is hereinafter referred to as "toner image trailing edge arrival timing." For example, values shown in Table 1 are set as the toner image leading edge arrival timings and the toner image trailing edge arrival timings in accordance with the judgment colors and the detection patterns. Those values correspond to values of the rotation counter given when the leading edges and the trailing edges of the toner images arrive at the density sensor 218 with the start of rotation of the intermediate transfer belt 205 being a reference.

TABLE 1

| | First pattern | | Second pattern | |
|---|---|---|---|---|
| | Leading edge | Trailing edge | Leading edge | Trailing edge |
| Y | 625 | 688 | 875 | 938 |
| M | 1250 | 1313 | 1500 | 1563 |
| C | 1875 | 1938 | 2125 | 2188 |
| K | 2500 | 2563 | 2750 | 2813 |

For example, when the detection pattern is set to the first pattern, the following state is given. The timing at which the leading edge of the toner image of yellow (Y) arrives at the position of the density sensor 218 corresponds to the time when the rotation counter indicates 625, and the timing at which the trailing edge arrives at the position of the density sensor 218 corresponds to the time when the rotation counter indicates 688. Further, when the detection pattern is the second pattern, the toner image leading edge arrival timing of yellow (Y) corresponds to the time when the rotation counter indicates 875, and the toner image trailing edge arrival timing corresponds to the time when the rotation counter indicates 938.

In Step S206, the mounting judgment portion 801 refers to the rotation counter to judge whether or not a value of the rotation counter has reached the toner image leading edge arrival timing. In Step S206, when the mounting judgment portion 801 judges that the value has not reached the toner image leading edge arrival timing, the processing returns to Step S206. When the mounting judgment portion 801 judges that the value has reached the toner image leading edge arrival timing, the processing proceeds to Step S207.

In Step S207, the mounting judgment portion 801 compares the sensor output (voltage value) of the density sensor 218F acquired by the toner detector 809 with a toner presence threshold value to judge whether or not the sensor output is smaller than the toner presence threshold value. In Step S207, when the sensor output is smaller than the toner presence threshold value, the mounting judgment portion 801 judges that the toner is present on the intermediate transfer belt 205, and the processing proceeds to Step S208. When the sensor output is equal to or larger than the toner presence threshold value, the mounting judgment portion 801 judges that the toner is not present on the intermediate transfer belt 205, and the processing proceeds to Step S209. In Step S208, the mounting judgment portion 801 increments the toner presence counter F (illustrated as "toner presence counter F++"). In the first embodiment, the toner presence threshold value is, for example, 1.8 V. After the mounting judgment portion 801 increments the toner presence counter F in Step S208, the processing proceeds to Step S209.

Similarly, in Step S209, the mounting judgment portion 801 compares the sensor output of the density sensor 218R acquired by the toner detector 809 with the toner presence threshold value to judge whether or not the sensor output is smaller than the toner presence threshold value. In Step S209, when the mounting judgment portion 801 judges that the sensor output is smaller than the toner presence threshold value, the processing proceeds to Step S210. When the mounting judgment portion 801 judges that the sensor output is equal to or larger than the toner presence threshold value, the processing proceeds to Step S211.

In Step S210, the mounting judgment portion 801 increments the toner presence counter R (illustrated as "toner presence counter R++"). After the mounting judgment portion 801 increments the toner presence counter R in Step S210, the processing proceeds to Step S211.

In Step S211, the mounting judgment portion 801 refers to the rotation counter to judge whether or not the value of the rotation counter has reached the toner image trailing edge detection timing. In Step S211, when the mounting judgment portion 801 judges that the value of the rotation counter has reached the toner image trailing edge detection timing, the processing proceeds to Step S212. When the mounting judgment portion 801 judges that the value of the rotation counter has not reached the toner image trailing edge detection timing, the processing returns to Step S207.

In Step S212, the mounting judgment portion 801 compares the toner presence counter F and the toner presence counter R with the pattern presence threshold value. Specifically, the mounting judgment portion 801 judges whether or not the toner presence counter F is equal to or larger than the pattern presence threshold value, or judges whether or not the toner presence counter R is equal to or larger than the pattern presence threshold value. In the first embodiment, the pattern presence threshold value is, for example, 38 (corresponding to 6 mm). In Step S212, when the mounting judgment portion 801 judges that any one of the toner presence counters is equal to or larger than the pattern presence threshold value, the processing proceeds to Step S213. When the mounting judgment portion 801 judges that both of the toner presence counters are smaller than the pattern presence threshold value, the processing proceeds to Step S214.

In Step S213, the mounting judgment portion 801 increments the pattern presence counter (illustrated as "pattern presence counter++").

In Step S214, the mounting judgment portion 801 increments the pattern forming counter (illustrated as "pattern forming counter++").

In Step S215, the mounting judgment portion 801 judges whether or not the pattern forming counter is equal to or larger than a pattern forming threshold value. In Step S215, when the mounting judgment portion 801 judges that the pattern forming counter is equal to or larger than the pattern forming threshold value, the processing proceeds to Step S217. When the mounting judgment portion 801 judges that the pattern forming counter is smaller than the pattern forming threshold value, the processing proceeds to Step S216. Here, the pattern forming threshold value corresponds to the number of image patterns arranged in the rotation direction, which is "2" in the first embodiment. In the case in which the detection pattern is the first pattern, when the processing has reached Step S215, the pattern forming counter is 1. Thus, in Step S216, the mounting judgment portion 801 sets the detection pattern to the second pattern. Then, the processing returns to Step S205, and Step S205 to Step S214 are repeatedly executed. In the case in which the detection pattern is the second pattern, when the processing has reached Step S215, the pattern forming counter is 2. Thus, in Step S215, the processing of the mounting judgment portion 801 proceeds to Step S217.

In Step S217, the mounting judgment portion 801 compares the pattern presence counter with the pattern forming threshold value. Specifically, the mounting judgment portion 801 judges whether or not the pattern presence counter is equal to or larger than the pattern forming threshold value. As mentioned above, the pattern forming threshold value corresponds to the number of image patterns arranged in the rotation direction, which is "2" in the first embodiment. In Step S217, when the mounting judgment portion 801 judges that the pattern presence counter is equal to or larger than the pattern forming threshold value, the processing proceeds to Step S218. When the mounting judgment portion 801 judges that the pattern presence counter is smaller than the pattern forming threshold value, the processing proceeds to Step S219.

That is, in the case in which the pattern presence counter is incremented in both the case in which the detection pattern is the first pattern and the case in which the detection pattern is the second pattern, the processing of the mounting judgment portion 801 proceeds to Step S218. When the pattern presence counter is not incremented in at least any one of the case in which the detection pattern is the first pattern and the case in which the detection pattern is the second pattern, the processing of the mounting judgment portion 801 proceeds to Step S219.

In Step S218, the mounting judgment portion 801 judges that the process cartridge 204 of the judgment color is mounted, and the processing of FIG. 8 is terminated. That is, when the first pattern and the second pattern arranged in the rotation direction are detected by the density sensor 218, the mounting judgment portion 801 judges that the process cartridge 204 (photosensitive drum 301) is mounted. In this case, the mounting judgment portion 801 may allow the display unit 230 to display information indicating that the corresponding process cartridge 204 (photosensitive drum 301) is mounted or information indicating that the image forming operation can be performed. The case in which the toner image is detected by the density sensor 218 means the case in which the output (voltage value) of the density sensor 218 becomes a value of a predetermined magnitude indicating the presence of the toner image.

In Step S219, the mounting judgment portion 801 judges that the process cartridge 204 of the judgment color is not mounted, and the processing of FIG. 8 is terminated. That is, when at least any one of the first pattern and the second pattern arranged in the rotation direction is not detected by the density sensor 218, the mounting judgment portion 801 judges that the process cartridge 204 (photosensitive drum 301) is not mounted. That is, when any one of or both of the first pattern and the second pattern arranged in the rotation direction is not detected by the density sensor 218, the mounting judgment portion 801 judges that the process cartridge 204 (photosensitive drum 301) is not mounted.

When the mounting judgment portion 801 judges that the process cartridge 204 (photosensitive drum 301) is not mounted, the display unit 230 may display information indicating that the corresponding process cartridge 204 (photosensitive drum 301) is not mounted.

The case in which the toner image is not detected by the density sensor 218 means the case in which the output (voltage value) of the density sensor 218 does not become the value of the predetermined magnitude indicating the presence of the toner image.

As shown in FIG. 4B, the sensor output voltage value of the density sensor 218 at the overlapping portion 228 may be reduced to the same level as those given at the positions at which the toner images are formed. As a result, there is a risk in that formation of the toner image is erroneously detected even through the toner image is not formed.

When forming the image pattern 900, the mounting judgment portion 801 forms toner images of each color at two positions in the rotation direction of the intermediate transfer belt 205. As mentioned above, the toner images formed at the two positions have an interval of 30 mm being the predetermined interval. This interval is larger than a maximum length (=25 mm) of overlapping portion 228 to be assumed. Thus, when the process cartridge 204 is mounted, the toner images formed at the two positions are not formed together in the region of the overlapping portion 228, and any one of the toner images is formed at a position that is not the overlapping portion 228.

The case in which the process cartridge 204 is not mounted is brought about as follows. In a case in which the overlapping portion 228 passes through the density sensor 218 at the timing of detecting the toner image on one side (for example, forward side), even when the presence of the toner image is erroneously detected, the overlapping portion 228 does not pass through the density sensor 218 at the detection timing of the toner image on another side (for example, rear side). That is, even when the presence of the toner image is erroneously detected on one side, the toner detector 809 detects that the toner image is not present on another side. Accordingly, the mounting judgment portion 801 can correctly detect that the toner image is not formed, that is, the one detected on one side is the overlapping portion 228. As a result, even when the presence of the toner image is erroneously detected due to the presence of the overlapping portion 228, the mounting judgment portion 801 can detect that the process cartridge 204 is not mounted.

The mounting judgment portion 801 judges that the process cartridge 204 is mounted when both the toner images formed at the two positions are detected. Thus, the mounting judgment portion 801 can correctly judge whether or not the process cartridge 204 is mounted.

In the image pattern 900, a total length of the toner images formed at the two positions for each color is 20 mm (=10 mm×2). Further, when the toner image which is longer than the overlapping portion 228 is formed, it is required that a toner image which is longer than the maximum length (=25 mm) to be assumed be formed. Therefore, according to the method described in this embodiment, consumption of toner can be suppressed as compared to the case in which the toner image which is longer than the maximum length (=25 mm) to be assumed is formed. Further, the mounting detection for the process cartridge 204 can be carried out without detecting the position of the overlapping portion 228 in advance. Therefore, elongation of the execution time of the mounting detection can be suppressed, and reduction in lifetime of the intermediate transfer belt 205 and the process cartridge 204 can be suppressed.

The size of the toner image is set to 10 mm in the image pattern 900 in order to prevent erroneous detection of the mounting state even when flaw or dirt is formed on the surface of the intermediate transfer belt 205. In the first embodiment, the maximum size of the flaw or dirt formed on the surface of the intermediate transfer belt 205 is assumed to be 5 mm, and the size of the toner image is set to be equal to or larger than 5 mm.

As described above, in the image forming apparatus which carries out the mounting detection for the process cartridge with use of the intermediate transfer member including the overlapping portion having an optical characteristic different from those of other portions, two toner images are formed with an interval that is longer than the length of the overlapping portion in the rotation direction. In this way, consumption of toner at the time of the mounting detection can be suppressed. Further, the mounting detection can be carried out without specifying the position of the overlapping portion. Thus, the execution time can be shortened. Further, reduction in lifetime of the process cartridge and the intermediate transfer member can be suppressed.

As described above, according to the first embodiment, the accuracy of the mounting detection for the process cartridge can be improved while suppressing consumption of toner.

The density sensor 218 may include any one of the density sensor 218F and the density sensor 218R. In this case, it is only required that the first pattern include at least one first toner image, and the second pattern include at least one second toner image.

For example, the density sensor 218 includes the density sensor 218F, and judgment of whether or not the process cartridge 204Y is mounted is carried out as follows. The first pattern includes the toner image 900$Y_{F1}$, and the second pattern includes the toner image 900$Y_{F2}$. The mounting judgment portion 801 judges that the process cartridge 204Y is mounted when the density sensor 218F detects both of the first pattern and the second pattern. The mounting judgment portion 801 judges that the process cartridge 204Y is not mounted when at least any one of the first pattern and the second pattern is not detected by the density sensor 218F. That is, when any one or both of the first pattern and the second pattern is not detected by the density sensor 218F, the mounting judgment portion 801 judges that the process cartridge 204Y is not mounted.

Further, one of the first pattern and the second pattern may be detected by the density sensor 218F, and another one of the first pattern and the second pattern may be detected by the density sensor 218R.

Second Embodiment

A second embodiment is described with reference to FIG. 9A, FIG. 9B, FIG. 10, FIG. 11A, and FIG. 11B. In the first embodiment, the configuration in which two toner images of the same color are formed in the rotation direction of the intermediate transfer belt 205 to thereby suppress consumption of toner as compared to the related art and carry out the mounting judgment is described. In the second embodiment, a configuration of forming an image pattern that further suppresses consumption of toner and carrying out the mounting judgment in a state in which the amount of toner that remains in the toner container 307 (hereinafter referred to as "residual toner amount") is small is described. A hardware configuration is the same as that of the first embodiment, and hence description thereof is omitted.

(Function Block Diagram)

Figure 9A:
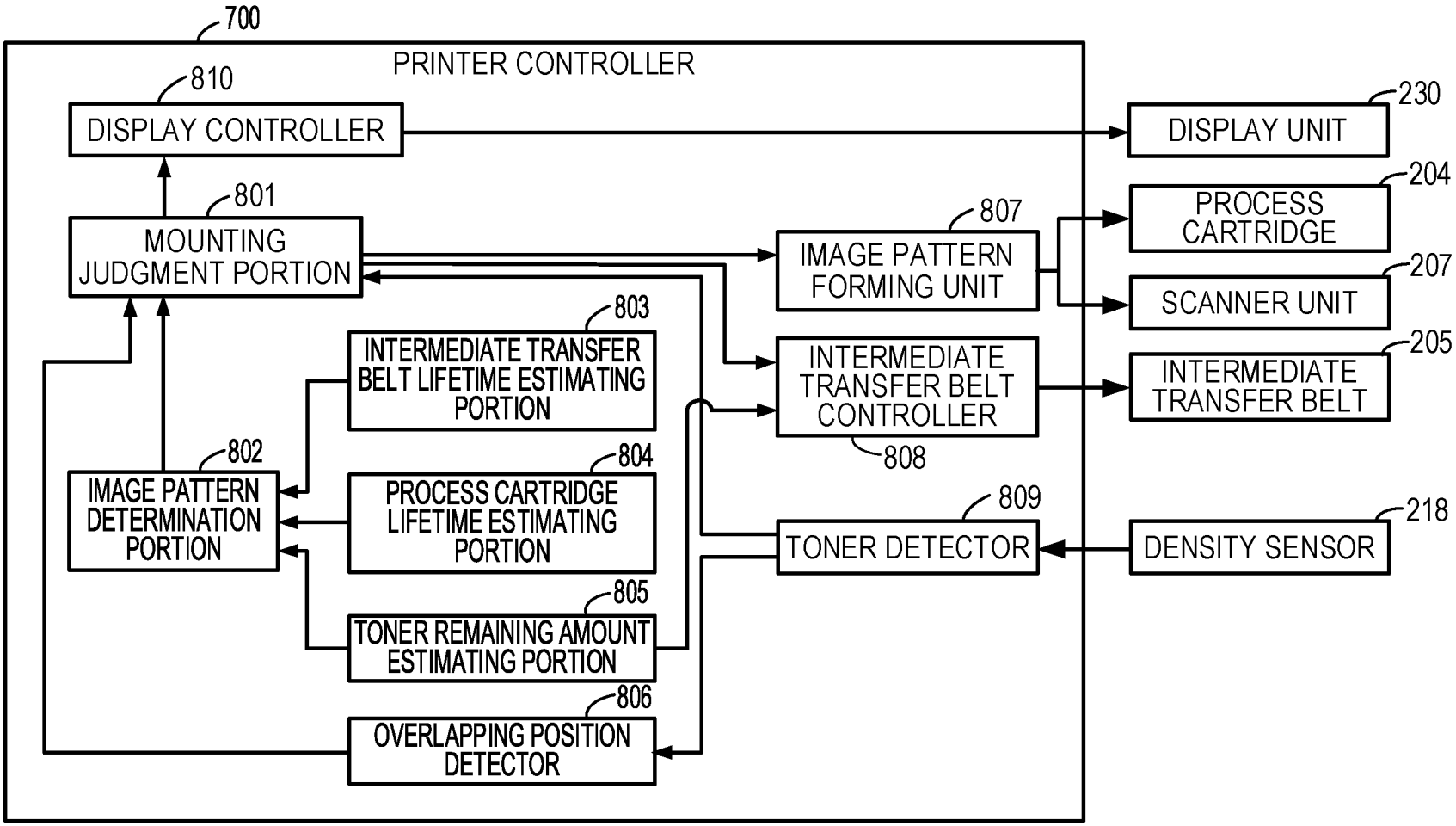
FIG. 9A is a function block diagram of the second embodiment.

FIG. 9A is a function block diagram of the second embodiment. Similarly to the first embodiment, the printer controller 700 includes the image pattern forming unit 807, the intermediate transfer belt controller 808, the toner detector 809, the display controller 810, and the mounting judgment portion 801. In the second embodiment, in addition, the printer controller 700 includes an intermediate transfer belt lifetime estimating portion 803 and a process cartridge lifetime estimating portion 804. The intermediate transfer belt lifetime estimating portion 803 is configured to estimate the lifetime of the intermediate transfer belt 205. The process cartridge lifetime estimating portion 804 is configured to estimate the lifetime of the photosensitive drum 301. Further, the printer controller 700 includes a toner remaining amount estimating portion 805, an image pattern determination portion 802, and an overlapping position detector 806 configured to detect a position of the overlapping portion 228.

The intermediate transfer belt lifetime estimating portion 803 being a first estimating unit estimates the lifetime of the intermediate transfer belt 205 (hereinafter referred to as "intermediate transfer belt lifetime"). Specifically, the intermediate transfer belt lifetime estimating portion 803 estimates the intermediate transfer belt lifetime by calculating a difference between an accumulated rotation time of the intermediate transfer belt motor 751 (see FIG. 5), with the start of use of the intermediate transfer belt 205 as a reference, and a rotation time given at the time of the arrival of the lifetime. In the second embodiment, the rotation time given at the time of the arrival of the lifetime of the intermediate transfer belt 205 is, for example, 450,000 seconds.

The process cartridge lifetime estimating portion 804 being a second estimating unit estimates the lifetime of the process cartridge 204 (photosensitive drum 301) (hereinafter referred to as "process cartridge lifetime"). Specifically, the process cartridge lifetime estimating portion 804 estimates the lifetime by calculating a difference between an accumulated rotation time of the drum motor 731, with the start of use of the process cartridge 204 as a reference, and a rotation time given at the time of the arrival of the lifetime. In the second embodiment, the rotation time given at the time of the arrival of the lifetime of the process cartridge 204 is, for example, 270,000 seconds.

The toner remaining amount estimating portion 805 being a third estimating unit estimates a residual toner amount in the toner container 307 of the process cartridge 204 (the amount of toner accommodated in the toner container 307). The toner remaining amount estimating portion 805 estimates a time for which printing can be performed with remaining toner (hereinafter referred to as "toner remaining amount time") by first calculating an accumulated time of irradiation of laser light with the scanner unit 207, with the start of use of the process cartridge 204 as a reference, and then calculating a difference between the accumulated time and an irradiation time given at the time of the arrival of the lifetime. In the second embodiment, the irradiation time given at the time of the arrival of the lifetime is, for example, 225,000 seconds.

Figure 9B:
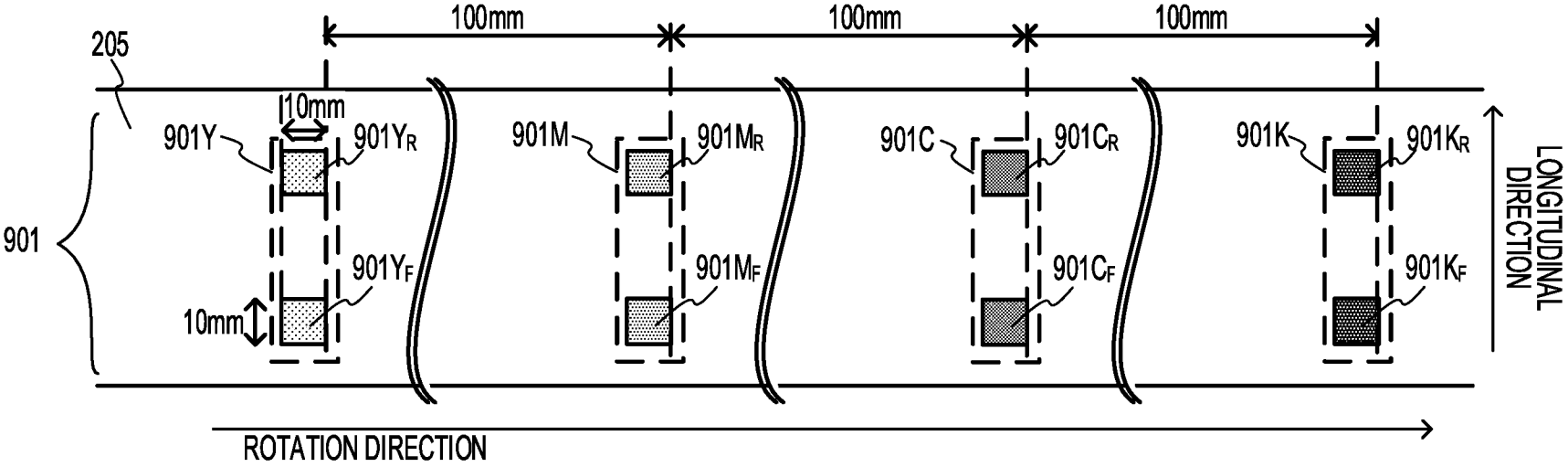
FIG. 9B is a schematic explanatory view for illustrating an image pattern of the second embodiment.

The image pattern determination portion 802 being a determination unit selects any one of the image pattern 900 illustrated in FIG. 6B and an image pattern 901 illustrated in FIG. 9B. The image pattern determination portion 802 performs the selection based on the intermediate transfer belt lifetime estimated by the intermediate transfer belt lifetime estimating portion 803, the process cartridge lifetimes of respective colors estimated by the process cartridge lifetime estimating portion 804, and the toner remaining amount time estimated by the toner remaining amount estimating portion 805.

In the state in which the process cartridge 204 is mounted to the image forming apparatus 200, the image pattern forming unit 807 controls the scanner unit 207 to allow the scanner unit 207 to perform the exposure operation, thereby forming the image pattern 901.

(Image Pattern)

FIG. 9B is a view for illustrating the image pattern of the second embodiment, in which the rotation direction and the longitudinal direction are also shown. The image pattern 901 includes image patterns 901Y, 901M, 901C, and 901K of respective colors.

The image pattern 901Y is an image pattern including two toner images, that is, a toner image 901$Y_F$ and a toner image 901$Y_R$ being detection images arranged in the longitudinal direction (detection toner images). Also with regard to the image patterns 901M, 901C, and 901K, two toner images are similarly formed in the longitudinal direction.

The image patterns 901Y, 901M, 901C, and 901K each include one toner image in the rotation direction of the intermediate transfer belt 205. The image patterns 901Y, 901M, 901C, and 901K are formed in such a manner as not to overlap the overlapping portion 228.

The size (10 mm×10 mm) and the position in the longitudinal direction of each toner image are the same as those of the image pattern 900. Further, intervals of respective leading edge positions of the image patterns 901Y, 901M, 901C, and 901K are also the same (100 mm). Information of the position and the size of the image pattern is stored in the ROM 704 in advance.

Now, description is made with reference to FIG. 9A again. The image pattern determination portion 802 selects the image pattern 901 which is smaller in consumption of toner than the image pattern 900 when the following conditions are satisfied.

The intermediate transfer belt lifetime is larger than an intermediate transfer belt lifetime threshold value being a first value.

The smallest lifetime among the process cartridge lifetimes of respective colors is larger than a process cartridge lifetime threshold value being a second value.

The shortest time among the toner remaining amount times of the respective colors is smaller than a toner remaining amount time threshold value corresponding to the predetermined toner amount (smaller than the predetermined toner amount).

Meanwhile, when the above-mentioned conditions are not satisfied, the image pattern determination portion 802 selects the image pattern 900. In the second embodiment, the intermediate transfer belt lifetime threshold value is 90,000 seconds, the process cartridge lifetime threshold value is 90,000 seconds, and the toner remaining amount time threshold value is 7,500 seconds.

The overlapping position detector 806 being a position detection unit detects a position of the overlapping portion 228 on the surface of the intermediate transfer belt 205 in the rotation direction. First, the intermediate transfer belt 205 is rotated by the intermediate transfer belt controller 808 at a speed of 80 mm/sec.

Next, the sensor output acquired by the toner detector 809 is monitored. During the monitoring, with regard to five sensor outputs acquired, for example, in the cycle of 2 ms and at the latest 5 times (corresponding to 10 ms), an average value of three sensor outputs excluding the maximum value and the smallest value (hereinafter referred to as "sensor output average value") is calculated, and the rotation counter is incremented. The rotation counter is initialized to 0 at the time of starting the monitoring.

When the sensor output average value is smaller than the sensor output threshold value of the overlapping portion 228, the overlapping position detector 806 stores the rotation counter as the overlapping portion rotation counter and stores the sensor output average value as the overlapping portion sensor output average value in the RAM 705. In the second embodiment, the overlapping portion sensor output threshold value is, for example, 1.8 V. When a plurality of timings at which the sensor output average value is smaller than the overlapping portion sensor output threshold value are detected, the overlapping position detector 806 stores the rotation counter and the sensor output average value of the one having a smaller sensor output average value. Then, when the rotation counter reaches the rotation counter threshold value, the monitoring is terminated, and the rotation counter is initialized to 0.

The rotation counter threshold value is a value corresponding to a time for one rotation of the intermediate transfer belt 205. In the second embodiment, the rotation counter threshold value is, for example, 5,000. As a result, the overlapping portion rotation counter corresponds to the rotation amount up to the overlapping portion 228 with the start of rotation being 0 as a reference. The overlapping portion rotation counter and the overlapping portion sensor output average value stored in the RAM 705 are initialized to 0 at the time of starting the rotation of the intermediate transfer belt 205. Further, the rotation counter is continuously incremented in the cycle of 2 ms. When the rotation counter reaches a value obtained by adding a predetermined additional rotation counter to the overlapping portion rotation counter stored in the RAM 705, the rotation of the intermediate transfer belt 205 is stopped by the intermediate transfer belt controller 808.

The additional rotation counter is a counter which is set such that the overlapping portion 228 stops at a position of not overlapping the primary transfer rollers 206 of all colors. In the second embodiment, the additional rotation counter is, for example, 1,250. The mounting judgment portion 801 forms the image pattern determined by the image pattern determination portion 802 on the surface of the intermediate transfer belt 205, and judges whether or not the process cartridge 204 is mounted based on the sensor output.

(Judgment Processing for Mounting State)

Figure 10:
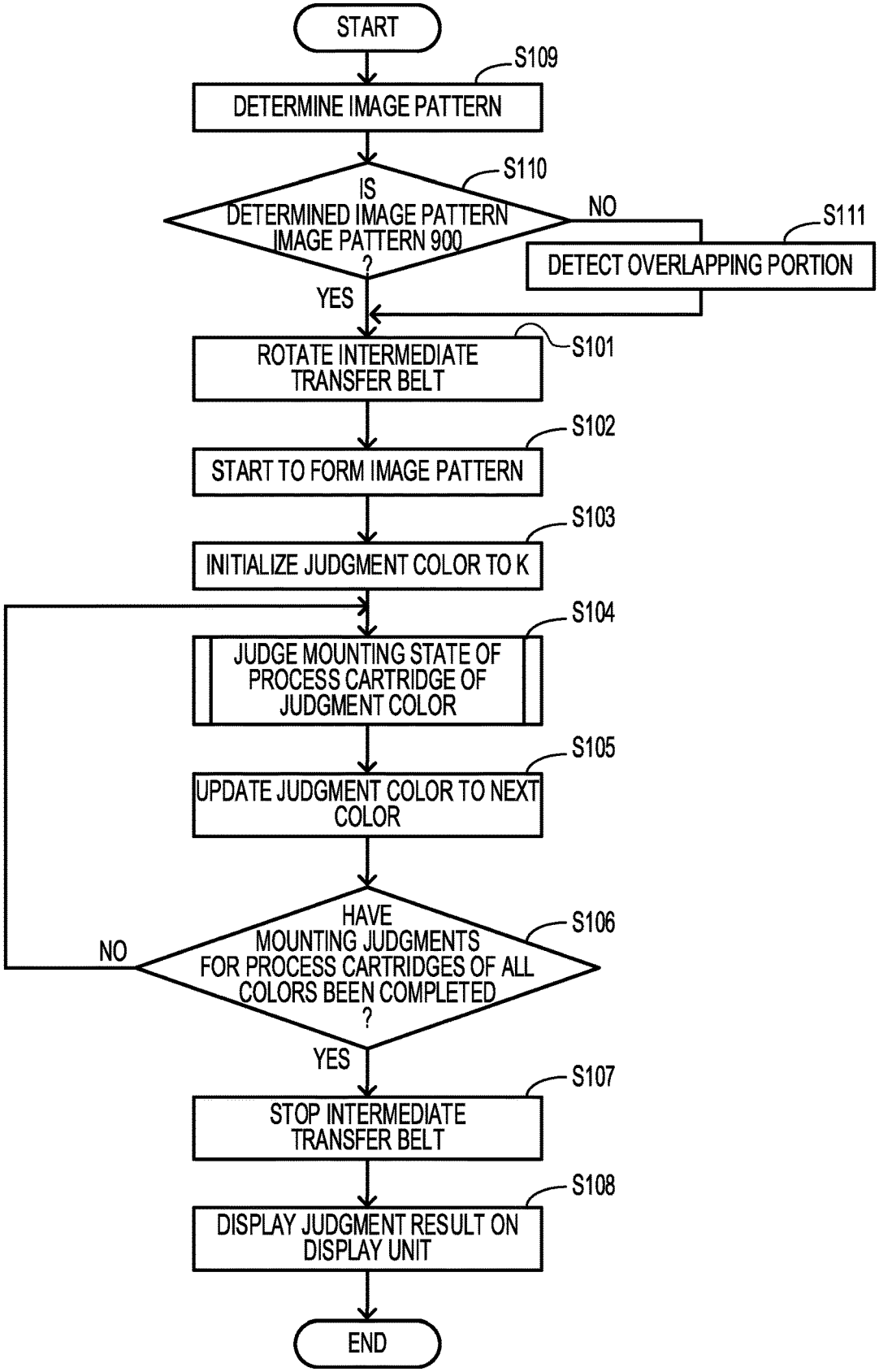
FIG. 10 is a flowchart for illustrating mounting judgment processing of the second embodiment.

The mounting judgment for the process cartridge by the mounting judgment portion 801 is described with reference to flowcharts of FIG. 10, FIG. 11A, and FIG. 11B. The flowchart of FIG. 10 is started at the timing at which the access door (not shown) is closed.

In Step S109, the mounting judgment portion 801 determines the image pattern based on the above-mentioned conditions with the image pattern determination portion 802.

In Step S110, the mounting judgment portion 801 judges whether or not the image pattern determined in Step S109 is the image pattern 900. In Step S110, when the mounting judgment portion 801 judges that the determined image pattern is the image pattern 900, the processing proceeds to Step S101. When the mounting judgment portion 801 judges that the determined image pattern is the image pattern 901, the processing proceeds to Step S111.

In Step S111, the mounting judgment portion 801 detects the position of the overlapping portion 228 with the overlapping position detector 806 by the above-mentioned method, and the processing proceeds to Step S101. As mentioned above, the mounting judgment portion 801 rotates the intermediate transfer belt 205 such that the overlapping portion 228 stops at the position of not overlapping the primary transfer roller 206, and then rotates the intermediate transfer belt 205 in Step S101. The operations of subsequent Step S102 to Step S108 are the same as those of FIG. 7 described in the first embodiment, and hence description thereof is omitted.

Figures 11, 11A:
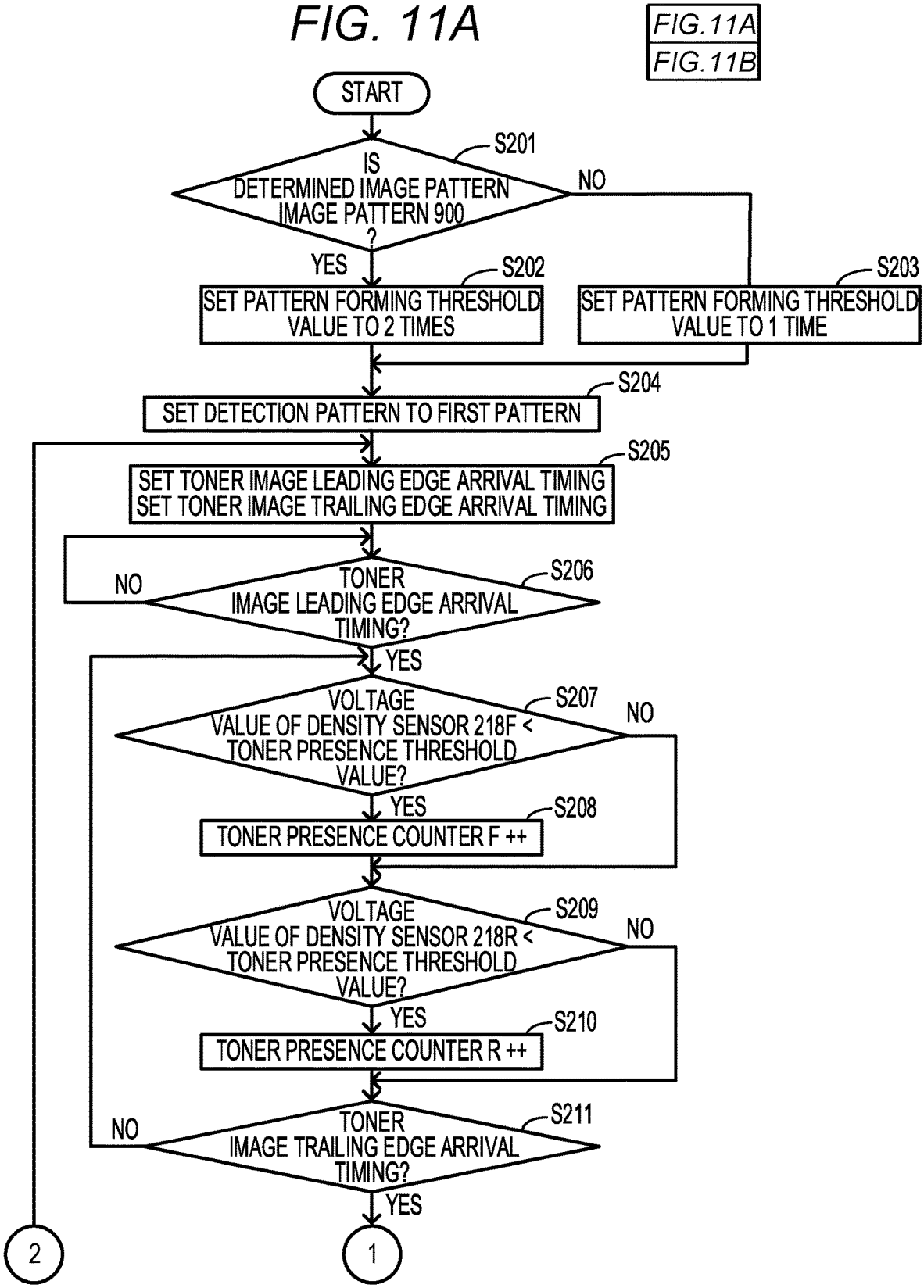
FIG. 11, comprised collectively of FIG. 11A and FIG. 11B, is a flowchart for illustrating the mounting judgment processing of the second embodiment.
Figure 11B:
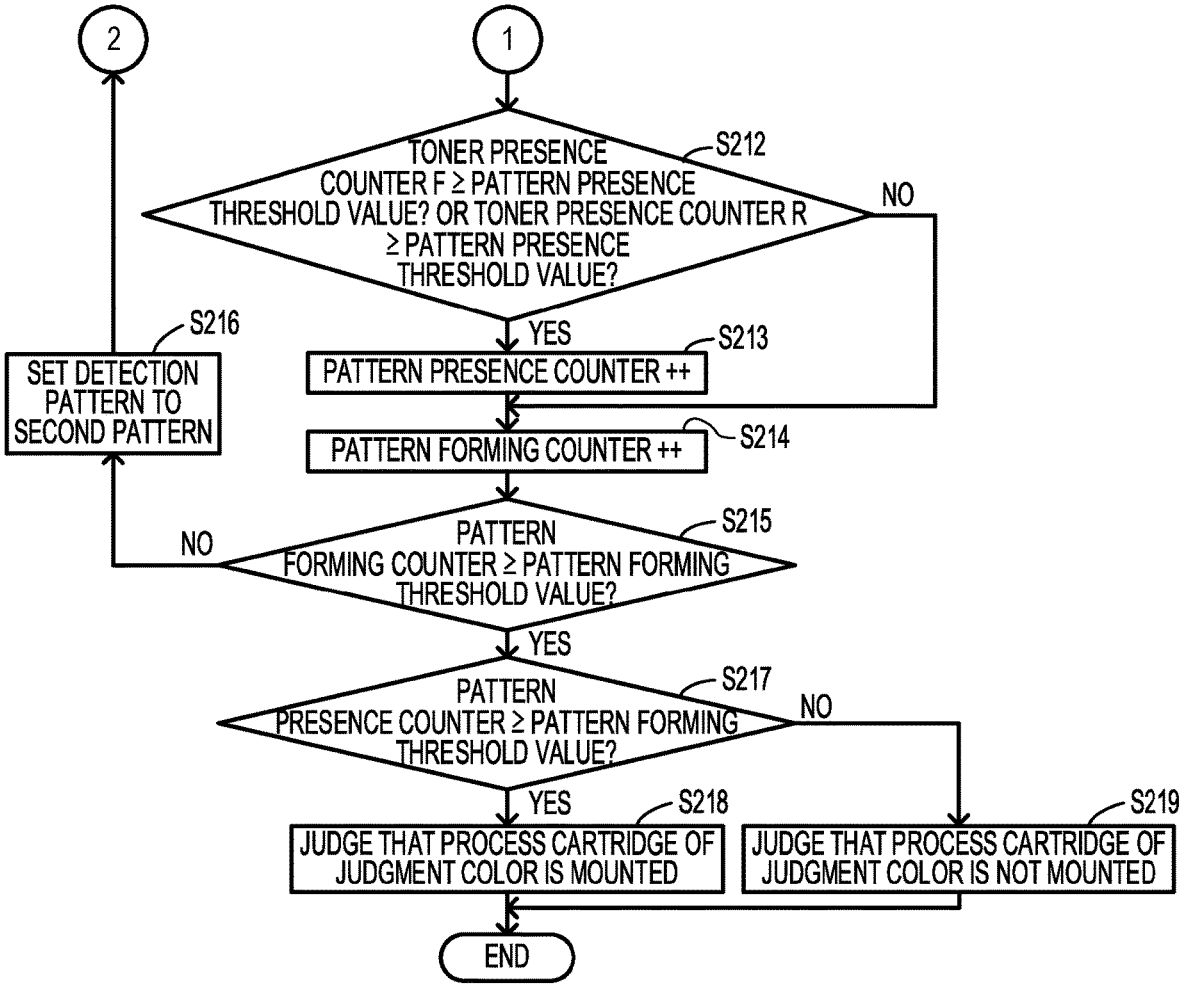

The flowchart of FIG. 11, comprised collectively of FIG. 11A and FIG. 11B, is the processing executed in Step S104 of FIG. 10. In the flowcharts of FIG. 11A and FIG. 11B, the mounting judgment portion 801 increments the rotation counter in the cycle of 2 ms.

In Step S201, based on the result determined in Step S109, the mounting judgment portion 801 judges whether or not the image pattern being formed is the image pattern 900. In Step S201, when the mounting judgment portion 801 judges that the image pattern is the image pattern 900, the processing proceeds to Step S202. When the mounting judgment portion 801 judges that the image pattern is the image pattern 901, the processing proceeds to Step S203.

In Step S202, the mounting judgment portion 801 sets the pattern forming threshold value to 2 times. In Step S203, the mounting judgment portion 801 sets the pattern forming threshold value to 1 time. The operations of subsequent Step S204 to Step S219 are the same as those of the first embodiment, and hence description thereof is omitted.

That is, when the image pattern 901 is used, one detection toner image is formed in the rotation direction of the intermediate transfer belt 205, and judgment of whether or not the process cartridge 204 is mounted is carried out based on whether or not the detection toner image is detected. Specifically, when one detection toner image is detected in the rotation direction of the intermediate transfer belt 205, it is judged that the process cartridge 204 is mounted.

In this embodiment, the mounting judgment portion 801 can judge whether or not the process cartridge 204 is mounted in the mode of using the image pattern 900 and in the mode of using the image pattern 901.

In the second embodiment, the image pattern 900 or the image pattern 901 is selected in accordance with the intermediate transfer belt lifetime, the process cartridge lifetime, and the residual toner amount, and the mounting judgment for the process cartridge 204 is carried out. When the image pattern 901 is selected, in order to avoid the overlapping portion 228, it is required that the position of the overlapping portion be detected before the image pattern is formed. However, the toner image is formed only at one position (one image pattern) for each color, and hence consumption of toner can be further suppressed. In a state in which the residual toner amount is sufficient, the image pattern 900 with a short execution time is selected. In a state in which the lifetime of the intermediate transfer belt 205 and the process cartridge 204 sufficiently remains while the residual toner amount is small, the image pattern 901 which is further suppressed in consumption of toner can be selected.

As described above, according to the second embodiment, the accuracy of the mounting detection for the process cartridge can be improved while suppressing consumption of toner.

Third Embodiment (Function Block Diagram)

A third embodiment is described with reference to FIG. 12A, FIG. 12B, FIG. 12C, FIG. 13, and FIG. 14. A hardware configuration is the same as that of the first embodiment, and hence description thereof is omitted. However, the length of the overlapping portion 228 of the third embodiment varies within the range of from 3 mm to 100 mm due to working.

Figure 12A:
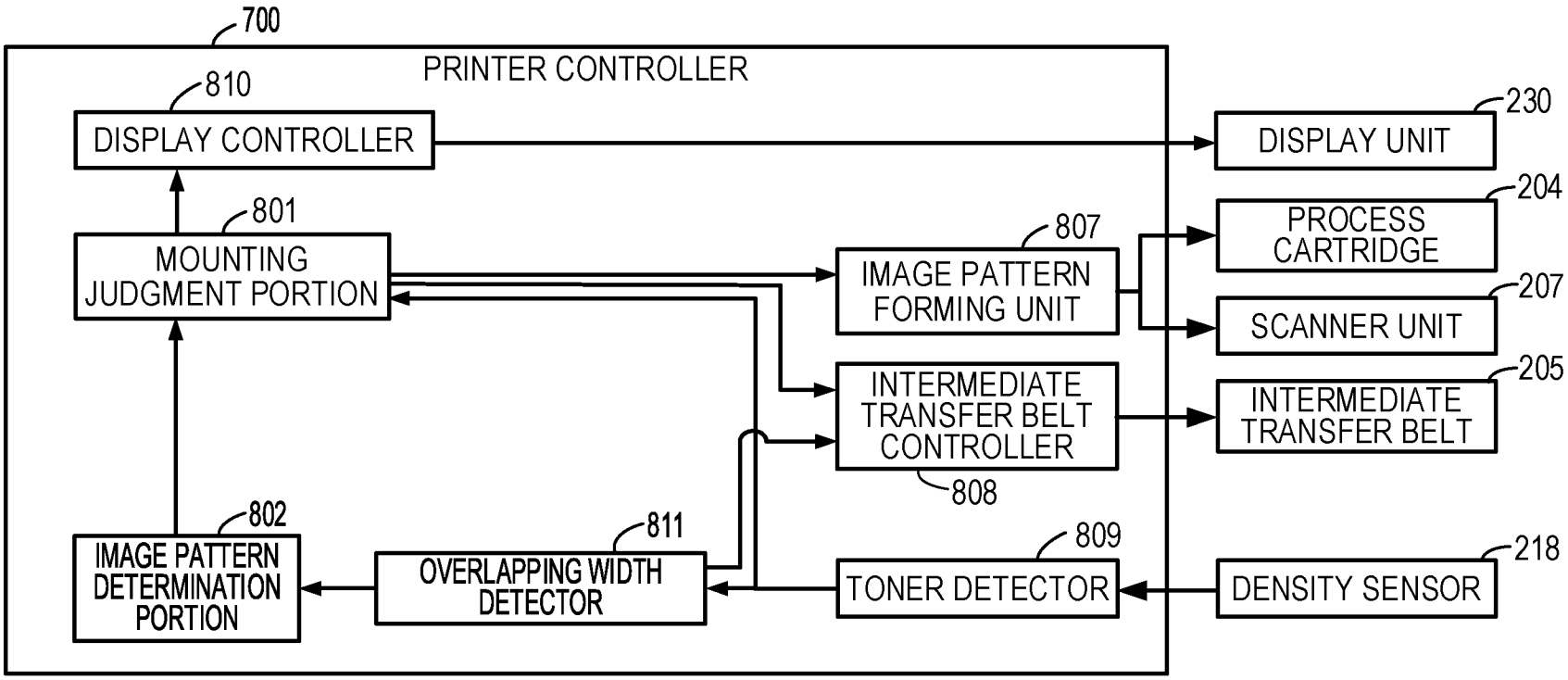
FIG. 12A is a function block diagram of the third embodiment.

FIG. 12A is a functional block diagram of the third embodiment. Similarly to the first embodiment, the printer controller 700 includes the image pattern forming unit 807, the intermediate transfer belt controller 808, the toner detector 809, the display controller 810, and the mounting judgment portion 801. In addition, the printer controller 700 includes the image pattern determination portion 802 and an overlapping width detector 811 configured to detect a width of the overlapping portion 228. The width of the overlapping portion 228 described herein corresponds to a length of the overlapping portion 228 in the rotation direction.

The overlapping width detector 811 being a length detection unit first rotates the intermediate transfer belt 205 at a speed of 80 mm/sec with the intermediate transfer belt controller 808. Next, the overlapping with detector 811 monitors the sensor output acquired with the toner detector 809. During the monitoring, with regard to five sensor outputs acquired in the cycle of 2 ms and at the latest 5 times (corresponding to 10 ms), an average value of three sensor outputs excluding the maximum value and the smallest value, that is, the sensor output average value is calculated, and the rotation counter is incremented. The rotation counter is initialized to 0 at the time of starting the monitoring.

When the sensor output average value is smaller than the overlapping portion sensor output threshold value, the mounting judgment portion 801 increments an overlapping width counter. Meanwhile, when the sensor output average value is equal to or larger than the overlapping portion sensor output threshold value, the mounting judgment portion 801 stores the overlapping width counter in the RAM 705 and initializes the overlapping width counter to 0. In the third embodiment, the overlapping portion sensor output threshold value is, for example, 1.8 V.

At the time of storing the overlapping width counter in the RAM 705, when the overlapping width counter has already been stored, the mounting judgment portion 801 stores a larger value in the RAM 705. Then, when the rotation counter reaches the rotation counter threshold value, the mounting judgment portion 801 terminates the monitoring, and stops the intermediate transfer belt 205 with the intermediate transfer belt controller 808. The rotation counter threshold value is a value corresponding to a time for one rotation of the intermediate transfer belt 205. In the third embodiment, the rotation counter threshold value is, for example, 5,000. As a result, the rotation amount corresponding to the length of the overlapping portion 228 in the rotation direction of the intermediate transfer belt 205 (hereinafter referred to as "overlapping portion rotation amount") is stored in the RAM 705.

(Image Pattern)

The image pattern determination portion 802 of the third embodiment determines the image pattern based on the overlapping portion rotation amount measured by the overlapping width detector 811.

Figure 12B:
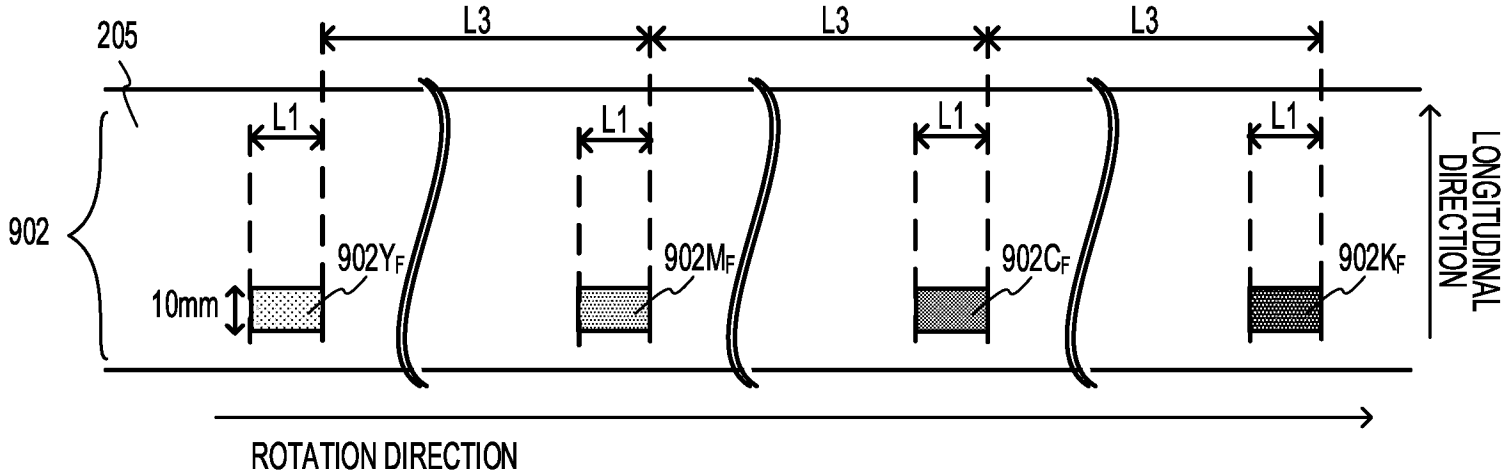
FIG. 12B is a schematic explanatory view for illustrating an image pattern of the third embodiment.
Figure 12C:
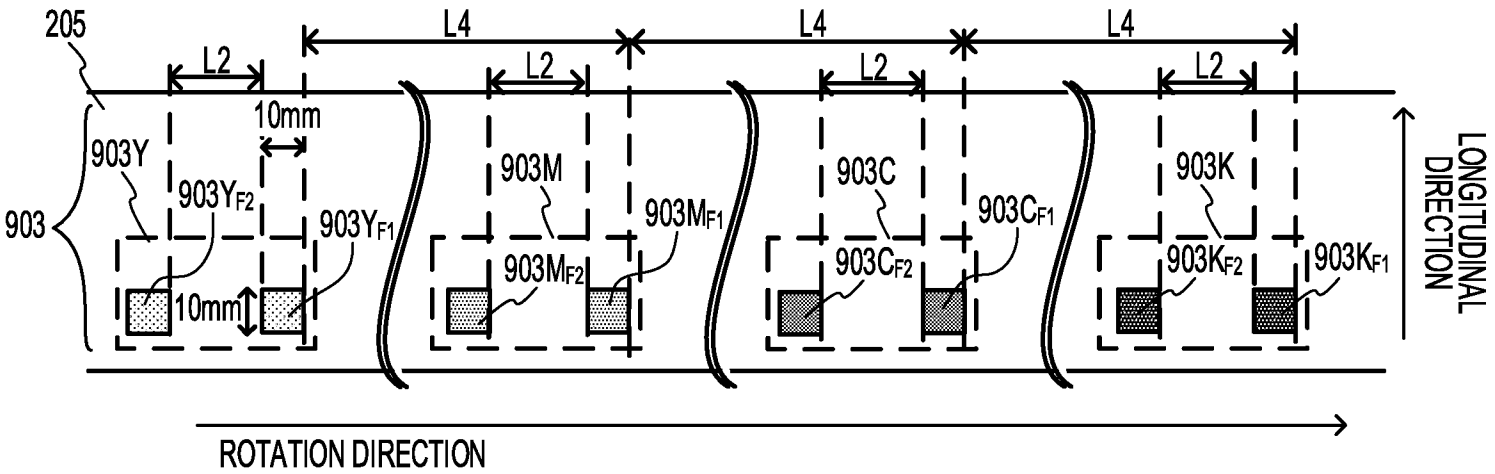
FIG. 12C is a schematic explanatory view for illustrating an image pattern of the third embodiment.

FIG. 12B and FIG. 12C are views for illustrating image patterns of the third embodiment, and the rotation direction and the longitudinal direction are indicated by arrows. An image pattern 902 of FIG. 12B includes toner images (detection toner images) 902$Y_F$, 902$M_F$, 902$C_F$, and 902$K_F$ of respective colors being detection images.

A length of each of the toner images 902$Y_F$, 902$M_F$, 902$C_F$, and 902$K_F$ in the rotation direction of the intermediate transfer belt 205 is $L_1$, which is determined based on the overlapping portion rotation amount (corresponding to the width of the overlapping portion 228) by a method described later. A length of each toner image in the longitudinal direction is, for example, 10 mm, similarly to the first embodiment. In the image pattern 902, the number of toner images of each color arranged in the rotation direction of the intermediate transfer belt 205 is 1.

Further, in the first embodiment, the toner images are formed at the positions at which the toner images can be detected by both the density sensor 218F and the density sensor 218R. However, in the third embodiment, the toner image is formed only at a position at which the toner image can be detected by any one of the density sensors, for example, by the density sensor 218F. The respective leading edge positions of the toner images 902$Y_F$, 902$M_F$, 902$C_F$, and 902$K_F$ are located at positions apart from one another at the interval of $L_3$.

An image pattern 903 of FIG. 12C includes image patterns 903Y, 903M, 903C, and 903K. In the image pattern 903, the number of toner images (detection toner images) of each color arranged in the rotation direction of the intermediate transfer belt 205 is 2.

The image pattern 903Y is an image pattern including two toner images, specifically, a toner image 903$Y_{F1}$ and a toner image 903$Y_{F2}$ being detection images arranged in the rotation direction. Similarly to the image pattern 902, the image pattern 903 has toner images formed only at the positions at which the toner images can be detected by any one of the two density sensors 218, for example, by the density sensor 218F. A size (10 mm) and a position of each toner image in the longitudinal direction is the same as those of the image pattern 902Y. A position of the toner image 903$Y_{F2}$ in the rotation direction is a position apart from the toner image 903$Y_{F1}$ as a reference by an interval of $L_2$. A length of each of the toner images 903$Y_{F2}$ and 903$Y_{F1}$ in the rotation direction is, for example, 10 mm, similarly to the first embodiment. The interval $L_2$ is determined based on the overlapping portion rotation amount by a method described later. The image patterns 903M, 903C, and 903K also have the same size and positional relationship as those of the image pattern 903Y. The respective leading edge positions of the image patterns 903Y, 903M, 903C, and 903K are located at positions apart from one another at the interval of $L_4$.

In the state in which the process cartridge 204 is mounted to the image forming apparatus 200, the image pattern forming unit 807 controls the scanner unit 207 to allow the scanner unit 207 to perform the exposure operation, thereby forming the image pattern 902 or the image pattern 903.

Now, description is made with reference to FIG. 12A again. The image pattern determination portion 802 determines how many detection toner images can be arranged in the rotation direction of the intermediate transfer belt 205 in accordance with the overlapping portion rotation amount measured by the overlapping width detector 811. The image pattern determination portion 802 selects the image pattern 902 when the overlapping portion rotation amount measured by the overlapping width detector 811 is a predetermined value, for example, a value smaller than 94 (corresponding to 15 mm). The image pattern determination portion 802 selects the image pattern 903 (two image patterns in the rotation direction) when the overlapping portion rotation amount is equal to or larger than the predetermined value, for example, equal to or larger than 94 (corresponding to 15 mm).

When the image pattern 902 is selected, a value obtained by adding a detection margin $M_1$ to a detection overlapping portion width [mm] converted from the overlapping portion rotation amount into the length unit of mm is set as the length $L_1$ of each of the toner images 902$Y_F$, 902$M_F$, 902$C_F$, and 902$K_F$. In the third embodiment, the detection margin $M_1$ is, for example, 5 mm. A larger one of a value obtained by adding a detection margin $M_3$ to the length $L_1$ and 100 mm (length between the photosensitive drums 301) is set as an interval $L_3$ of the respective leading edge positions of the image patterns 902Y, 902M, 902C, and 902K. In the third embodiment, the detection margin $M_3$ is 10 mm.

When the image pattern 902 is selected, a value obtained by adding a detection margin $M_2$ to the detection overlapping portion width is set as a length $L_2$ of the toner images of each color. In the third embodiment, the detection margin $M_2$ is, for example, 5 mm. A larger one of a value obtained by adding the interval $L_2$ of the toner images and a detection margin $M_4$ to 20 mm (=toner image 10 mm×2) and 100 mm is set as an interval $L_4$ of the respective leading edge positions of the image patterns 903Y, 903M, 903C, and 903K. In the third embodiment, the detection margin $M_4$ is 10 mm.

For example, when the measured length of the overlapping portion 228 is 25 mm, and the interval $L_2$ of the toner images is 30 mm, the interval $L_4$ is 100 mm, which is the length between the photosensitive drums 301. Thus, when formation of the images of the respective colors is started simultaneously, the determined image pattern can be formed.

Meanwhile, when the measured length of the overlapping portion 228 is 70 mm, and the interval $L_2$ of the toner images is 75 mm, the interval $L_4$ is 105 mm, which exceeds 100 mm being the length between the photosensitive drums 301. Thus, the image pattern forming unit 807 forms the toner images with deviation in timing of starting image formation in respective colors.

(Judgment Processing for Mounting State)

The mounting judgment processing for the process cartridge 204 by the mounting judgment portion 801 is described with reference to flowcharts of FIG. 13 and FIG. 14. The flowchart of FIG. 13 is started at the timing at which the access door (not shown) is closed.

In Step S112, the mounting judgment portion 801 determines the image pattern in accordance with the width of the overlapping portion 228 measured by the method described above with the image pattern determination portion 802. The operations of subsequent Step S101 to Step S108 are the same as those of FIG. 7 described in the first embodiment, and hence description thereof is omitted.

Figure 13:
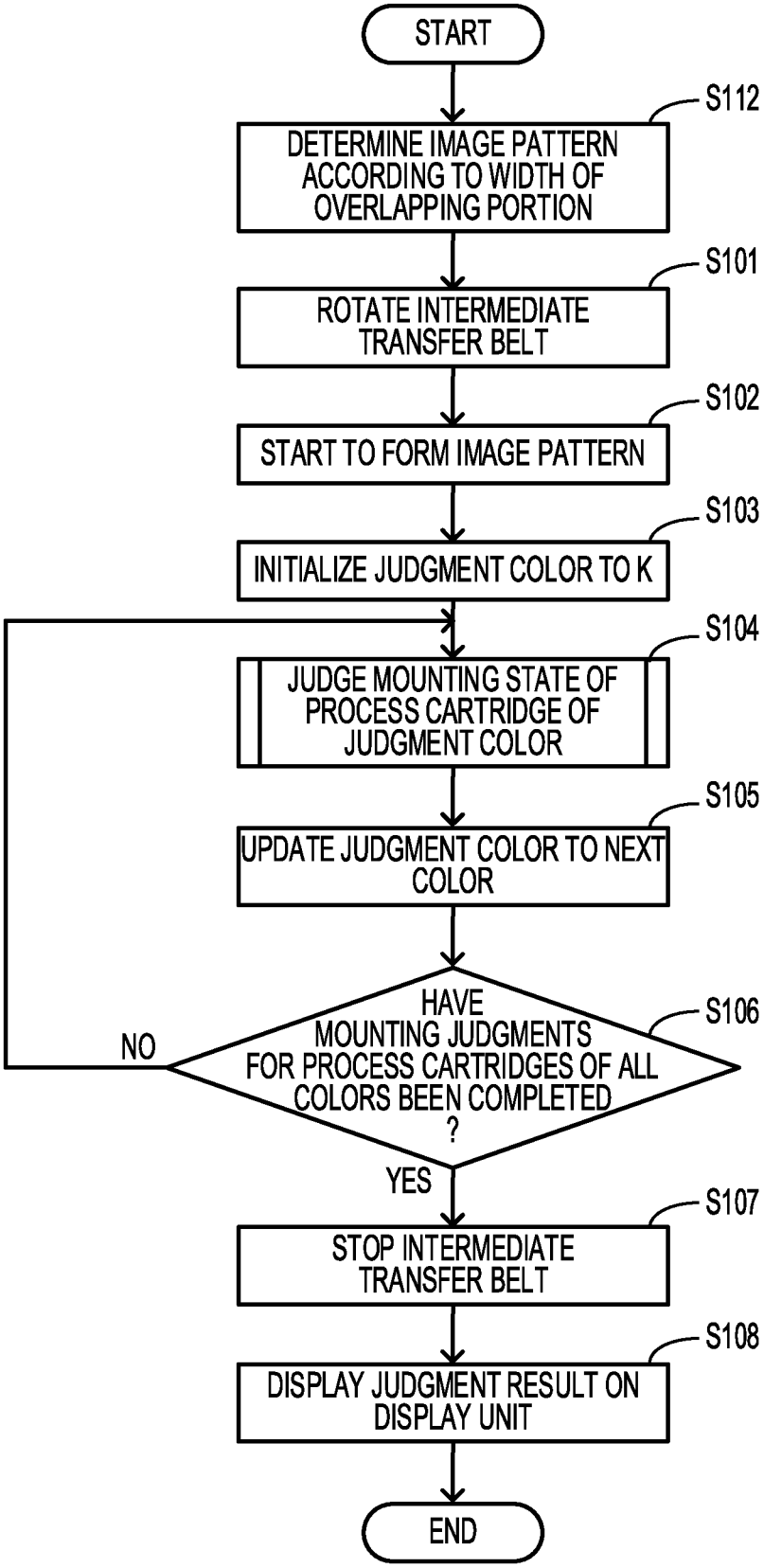
FIG. 13 is a flowchart for illustrating mounting judgment processing of the third embodiment.
Figure 14:
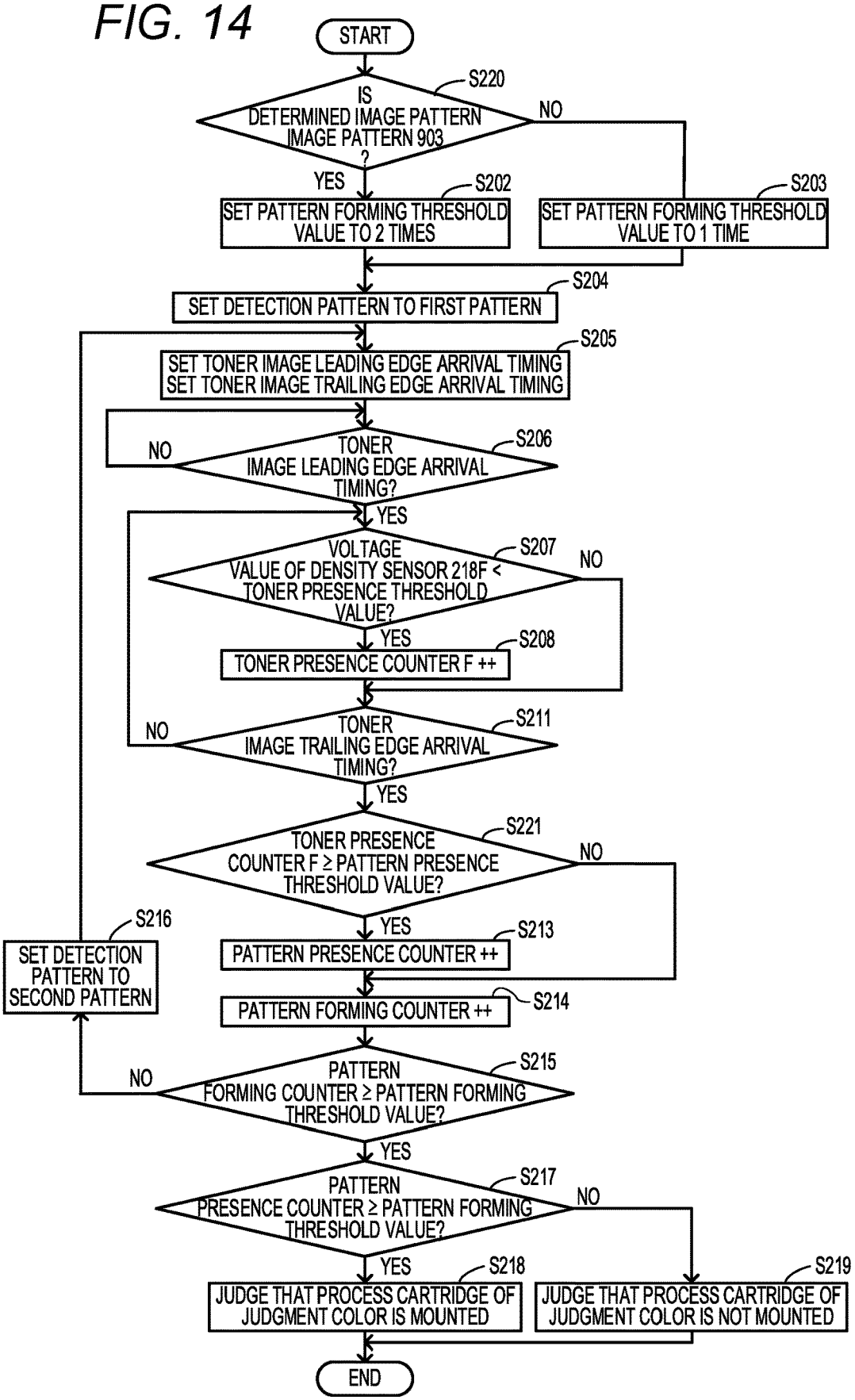
FIG. 14 is a flowchart for illustrating the mounting judgment processing of the third embodiment.

The flowchart of FIG. 14 shows the processing executed in Step S104 of FIG. 13. In the flowchart of FIG. 14, the rotation counter is incremented in the cycle of 2 ms. In Step S220, the mounting judgment portion 801 judges whether or not the image pattern (being formed), which is determined in Step S112, is the image pattern 903.

In Step S220, when the mounting judgment portion 801 judges that the image pattern being formed is the image pattern 903, the processing proceeds to Step S202. When the mounting judgment portion 801 judges that the image pattern being formed is the image pattern 902, the processing proceeds to Step S203. Accordingly, when the image pattern is the image pattern 903, the pattern forming threshold value is set to 2 times. When the image pattern is the image pattern 902, the pattern forming threshold value is set to 1 time.

When the pattern forming threshold value is set to 2 times, the mounting judgment portion 801 judges that the process cartridge 204 is mounted in the case in which all of the two toner images arranged in the rotation direction of the intermediate transfer belt 205 are detected. When any one of the two toner images arranged in the rotation direction of the intermediate transfer belt 205 is not detected, and when both of the two toner images are not detected, the mounting judgment portion 801 judges that the process cartridge 204 is not mounted.

In the third embodiment, the toner image leading edge arrival timing and the toner image trailing edge arrival timing are set as follows. That is, based on the length $L_1$ and the interval $L_3$, or the interval $L_2$ and the interval $L_4$ determined by the image pattern determination portion 802 for each of the judgment color and the detection pattern, values of the rotation counter given at the arrival of the leading edge and the trailing edge of each toner image to the density sensor 218 with the start of rotation as a reference are set.

The operations of subsequent Step S204 to Step S208, Step S211, and Step S213 to Step S219 are the same as those of the first embodiment. The difference from the first embodiment is that the mounting judgment is carried out with use of only the detection result of the density sensor 218F, and the processing of Step S209 and Step S210 related to the density sensor 218R in FIG. 8 is not present. Further, only the toner presence counter F is used, and hence in Step S221, the mounting judgment portion 801 judges whether or not the toner presence counter F is equal to or larger than the pattern presence threshold value. In Step S221, when the mounting judgment portion 801 judges that the toner presence counter F is equal to or larger than the pattern forming threshold value, the processing proceeds to Step S213. When the mounting judgment portion 801 judges that the toner presence counter F is smaller than the pattern presence threshold value, the processing proceeds to Step S214. In Step S213, the mounting judgment portion 801 increments the pattern presence counter.

In the third embodiment, the mounting judgment portion 801 can judge whether or not the process cartridge 204 is mounted in the mode of using the image pattern 903 and in the mode of using the image pattern 902.

According to the third embodiment, the length of the overlapping portion 228 is measured, and the image forming pattern is dynamically determined in accordance with the length. In the first embodiment, two toner images each having a length of 10 mm in the rotation direction are formed, and hence consumption of toner corresponding to 20 mm in total is required. Meanwhile, in the third embodiment, one toner image having a length smaller than 20 mm is formed when the length of the overlapping portion 228 is smaller than 15 mm, and two toner images each having a length of 10 mm are formed when the length of the overlapping portion 228 is equal to or larger than 15 mm. As a result, toner consumption given in the case in which the intermediate transfer belt 205 in which the length of the overlapping portion 228 is short is used can be suppressed.

Further, the length $L_1$ of the toner image given in the case in which the image pattern 902 is selected is set to a required minimum length in accordance with the length of the overlapping portion 228, and hence the consumption of toner is suppressed. Further, in the third embodiment, the toner images are formed only at the positions at which the toner images can be detected by the density sensor 218F, and hence the consumption of toner can be further suppressed.

Modification Example 1

The embodiment is not limited to the third embodiment. In the third embodiment, there is given the image pattern in which the toner images are formed only at the positions at which the toner images can be detected by the density sensor 218F. However, the toner images may be formed only at the positions at which the toner images can be detected by the density sensor 218R.

In the image pattern 903, two toner images of each color are formed at positions at which the toner images can be detected by the density sensor 218F. However, the image pattern 903 is not limited to this arrangement. Two image patterns arranged in the rotation direction may be formed at such positions that one of the two image patterns can be detected by one density sensor and another one of the two image patterns can be detected by another density sensor.

Figure 15:
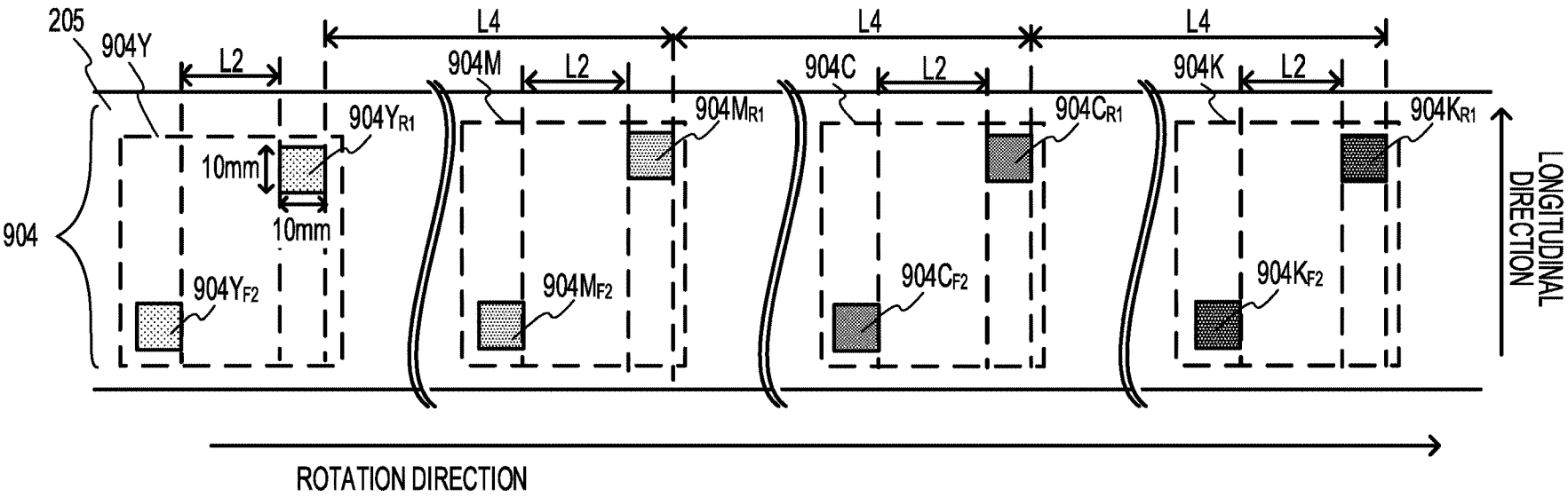
FIG. 15 is a schematic explanatory view for illustrating an image pattern of the third embodiment.

FIG. 15 is a view for illustrating a modification example of the image pattern, and the rotation direction and the longitudinal direction are indicated by arrows. As in an image pattern 904 (904Y, 904M, 904C, 904K) illustrated in FIG. 15, one toner image may be formed at the position at which the toner image can be detected by the density sensor 218F, and another one toner image may be formed at the position at which the toner image can be detected by the density sensor 218R. For example, in the case of the image pattern 904Y of yellow, a toner image 904$Y_{R1}$ being a detection image is formed at a position at which the toner image 904$Y_{R1}$ is detected by the density sensor 218R, and the toner image 904$Y_{F2}$ is formed at a position at which the toner image 904$Y_{F2}$ is detected by the density sensor 218F. This holds true for other colors. In this case, the length of the toner image in each of the rotation direction and the longitudinal direction is 10 mm, the interval between the two toner images is $L_2$, and the interval of the image patterns of respective colors is $L_4$. The intervals $L_2$ and $L_4$ are determined in the above-mentioned manner.

In FIG. 15, the toner images 904$Y_{R1}$ and 904$Y_{F2}$ are given. However, toner images 904$Y_{F1}$ and 904$Y_{R2}$ may be given.

Further, the mode in which the length of the overlapping portion 228 is measured every time the mounting state is judged. However, when the length of the overlapping portion 228 has already been measured, the measured value is stored in the RAM 705, and a previous measurement result may be read out from the RAM 705 and reused.

As described above, according to the third embodiment, the accuracy of the mounting detection for the process cartridge can be improved while suppressing consumption of toner.

Modification Example 2

In each of the above-mentioned embodiments, the mounting judgment portion 801 judges whether or not the process cartridge 204 including the photosensitive drum 301 and the developing roller 303 is mounted to the image forming apparatus 200. However, the present disclosure is not limited to this.

For example, the mounting judgment portion 801 may judge whether or not a cartridge including the photosensitive drum 301 is mounted to the image forming apparatus 200. Further, the mounting judgment portion 801 may judge whether or not a cartridge including the developing roller 303 is mounted to the image forming apparatus 200. In this case, the photosensitive drum 301 may be removably mounted to the image forming apparatus 200, or may be unremovably mounted to the image forming apparatus 200.

In any case, when the cartridge is not mounted to the image forming apparatus 200, the detection image is not formed on the intermediate transfer belt 205. Thus, the mounting judgment portion 801 is capable of judging whether or not the cartridge is mounted in a manner similar to those of the embodiments.

According to the present disclosure, the accuracy of the mounting detection for the process cartridge can be improved while suppressing consumption of toner.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-212491, filed Dec. 22, 2020, which is hereby incorporated by reference herein in its entirety.

What is claimed is:

1. An image forming apparatus that has an image bearing member to be removably mounted to the image forming apparatus, the image forming apparatus comprising:

an intermediate transfer member which is rotatable, and to which a toner image borne by the image bearing member is to be transferred;

a toner detection unit configured to detect the toner image on a surface of the intermediate transfer member;

an exposure device configured to expose the image bearing member;

a forming unit configured to control the exposure device so that the exposure device performs a first exposure operation, and a second exposure operation after elapse of a predetermined time period from the first exposure operation; and a judgment unit configured to judge a mounting state of the image bearing member based on whether or not the toner image transferred on the surface of the intermediate transfer member is detected by the toner detection unit, wherein, in a case in which the image bearing member is mounted, a first pattern including a first toner image is formed by the first exposure operation, and a second pattern including a second toner image is formed by the second exposure operation, where the second pattern is formed apart from the first pattern by a predetermined interval in a rotation direction of the intermediate transfer member, wherein, in a case in which the first pattern and the second pattern are detected by the toner detection unit, the judgment unit judges that the image bearing member is mounted, and wherein, in a case in which at least one of the first pattern and the second pattern is not detected by the toner detection unit, the judgment unit judges that the image bearing member is not mounted.

2. The image forming apparatus according to claim 1, wherein the toner detection unit is configured to optically detect a presence or absence of the toner image on the surface of the intermediate transfer member, wherein the intermediate transfer member is an endless belt, and includes a first portion and a second portion which is different in optical characteristic from the first portion, and wherein the predetermined interval is longer than a length of the second portion in the rotation direction.

3. The image forming apparatus according to claim 2, further comprising:

a toner container configured to contain toner;

a first estimating unit configured to estimate lifetime of the intermediate transfer member;

a second estimating unit configured to estimate lifetime of the image bearing member;

a third estimating unit configured to estimate a toner amount of the toner contained in the toner container; and a position detection unit configured to detect a position of the second portion, wherein, in a case in which the toner amount estimated by the third estimating unit is smaller than a predetermined toner amount, the lifetime of the intermediate transfer member estimated by the first estimating unit is larger than a first value, and the lifetime of the image bearing member estimated by the second estimating unit is larger than a second value, one detection toner image is formed with respect to the rotation direction so that the one detection toner image avoids the position of the second portion, and wherein, in a case in which the detection toner image is detected by the toner detection unit, the judgment unit judges that the image bearing member is mounted.

4. The image forming apparatus according to claim 1, wherein the toner detection unit is configured to optically detect a presence or absence of the toner image on the surface of the intermediate transfer member, wherein the intermediate transfer member is an endless belt, and includes a first portion and a second portion which is different in optical characteristic from the first portion, and wherein the predetermined time period is longer than a time period that is obtained by dividing a length of the second portion in the rotation direction by a movement speed of the surface of the intermediate transfer member.

5. The image forming apparatus according to claim 4, further comprising:

a toner container configured to contain toner;

a first estimating unit configured to estimate lifetime of the intermediate transfer member;

a second estimating unit configured to estimate lifetime of the image bearing member;

a third estimating unit configured to estimate a toner amount of the toner contained in the toner container; and a position detection unit configured to detect a position of the second portion, wherein, in a case in which the toner amount estimated by the third estimating unit is smaller than a predetermined toner amount, the lifetime of the intermediate transfer member estimated by the first estimating unit is larger than a first value, and the lifetime of the image bearing member estimated by the second estimating unit is larger than a second value, one detection toner image is formed with respect to the rotation direction so that the one detection toner image avoids the position of the second portion, and wherein, in a case in which the detection toner image is detected by the toner detection unit, the judgment unit judges that the image bearing member is mounted.

6. The image forming apparatus according to claim 1, wherein the first pattern includes a plurality of first toner images arranged in a direction orthogonal to the rotation direction, and the second pattern includes a plurality of second toner images arranged in the direction orthogonal to the rotation direction, and wherein, in a case in which at least one of the plurality of first toner images is detected by the toner detection unit and at least one of the plurality of second toner images is detected by the toner detection unit, the judgment unit judges that the image bearing member is mounted.

7. The image forming apparatus according to claim 1, wherein the toner detection unit includes a first detection unit and a second detection unit, and wherein the first detection unit is arranged at a first detection position in a direction orthogonal to the rotation direction, and the second detection unit is arranged at a second detection position in the direction orthogonal to the rotation direction.

8. The image forming apparatus according to claim 1, wherein a plurality of recessed portions arranged in a direction orthogonal to the rotation direction are formed on the surface of the intermediate transfer member.

9. The image forming apparatus according to claim 1, wherein the toner detection unit includes an irradiation portion configured to irradiate the surface of the intermediate transfer member with light and a light receiving portion configured to receive reflected light, and the toner detection unit is configured to optically detect the intermediate transfer member or the toner image transferred on the surface of the intermediate transfer member.

10. An image forming apparatus that has an image bearing member to be removably mounted to the image forming apparatus, the image forming apparatus comprising:

an intermediate transfer member that is an endless belt, includes a first portion and a second portion that is different in optical characteristic from the first portion, is rotatable, and to which a toner image borne by the image bearing member is to be transferred;

a toner detection unit configured to optically detect the toner image on a surface of the intermediate transfer member;

an exposure device configured to expose the image bearing member;

a forming unit configured to control the exposure device so that the exposure device performs an exposure operation;

a judgment unit configured to judge a mounting state of the image bearing member based on whether or not the toner image transferred on the surface of the intermediate transfer member is detected by the toner detection unit; and a determination unit configured to determine a number of detection toner images arranged in a rotation direction of the intermediate transfer member in accordance with a length of the second portion in the rotation direction, wherein, in a case in which all of the detection toner images of the number determined by the determination unit are detected by the toner detection unit, the judgment unit judges that the image bearing member is mounted, and wherein, in a case in which at least one of the detection toner images of the number is not detected by the toner detection unit, the judgment unit judges that the image bearing member is not mounted.

11. The image forming apparatus according to claim 10, further comprising a length detection unit configured to detect the length of the second portion in the rotation direction.

12. The image forming apparatus according to claim 11, wherein, in a case in which the length of the second portion detected by the length detection unit is equal to or larger than a predetermined value, the determination unit determines the number as 2 and, in a case in which the length of the second portion is smaller than the predetermined value, the determination unit determines the number as 1.

13. The image forming apparatus according to claim 12, wherein, in a case in which the number is determined as 2, the determination unit determines an interval of two detection toner images so that the interval is longer than the length of the second portion detected by the length detection unit.

14. The image forming apparatus according to claim 12, wherein, in a case in which the number is determined as 1, the determination unit determines a length of one detection toner image in the rotation direction to be longer than the length of the second portion detected by the length detection unit.

15. The image forming apparatus according to claim 12, wherein the toner detection unit includes a first detection unit and a second detection unit, and wherein the first detection unit is arranged at a first detection position in a direction orthogonal to the rotation direction, and the second detection unit is arranged at a second detection position in the direction orthogonal to the rotation direction.

16. The image forming apparatus according to claim 15, wherein the detection toner images are formed so as to be detectable at either the first detection position or the second detection position.

17. The image forming apparatus according to claim 15, wherein, in a case in which the number is determined as 2 by the determination unit, one of the detection toner images is formed at a position corresponding to the first detection position, and another one of the detection toner images is formed at a position corresponding to the second detection position.

* * * * *